US011925834B2

(12) United States Patent
Burke

(10) Patent No.: US 11,925,834 B2
(45) Date of Patent: Mar. 12, 2024

(54) MOBILE CYCLING APPARATUS

(71) Applicant: Tana Burke, Missoula, MT (US)

(72) Inventor: Tana Burke, Missoula, MT (US)

( * ) Notice: Subject to any disclaimer, the term of this patent is extended or adjusted under 35 U.S.C. 154(b) by 286 days.

(21) Appl. No.: 17/231,944

(22) Filed: Apr. 15, 2021

(65) Prior Publication Data

US 2021/0322820 A1 Oct. 21, 2021

Related U.S. Application Data

(60) Provisional application No. 63/010,483, filed on Apr. 15, 2020.

(51) Int. Cl.
*A63B 22/06* (2006.01)
*A63B 24/00* (2006.01)

(52) U.S. Cl.
CPC ..... *A63B 22/0605* (2013.01); *A63B 24/0087* (2013.01); *A63B 2022/0635* (2013.01); *A63B 2024/0093* (2013.01)

(58) Field of Classification Search
CPC .... A63B 2022/0611; A63B 2022/0617; A63B 2022/0623; A63B 2022/0629; A63B 2022/0635; A63B 2022/0641; A63B 2022/0647; A63B 2022/0652; A63B 2022/0658; A63B 22/0664; A63B 21/0089; A63B 71/0622; A63B 2225/20; A63B 2225/50; A63B 2225/72; A63B 2225/09; A63B 2225/096; A63B 2225/15; A63B 2230/06; A63B 2230/30; A63B 2230/50; A63B 2220/12; A63B 2220/16;
(Continued)

(56) References Cited

U.S. PATENT DOCUMENTS 2,121,750 A * 6/1938 Vaughan ..... A63B 24/0021 273/358
3,738,649 A * 6/1973 Miller ..... A63B 21/04 482/130

(Continued)

FOREIGN PATENT DOCUMENTS

EP 1423170 B1 * 8/2002 ..... A63B 21/08
WO WO 02074393 A2 * 3/2002 ..... A47C 7/62
WO WO 2019028484 A1 * 8/2018 ..... A61H 1/0274

OTHER PUBLICATIONS

EP_1423170_B1_I_translate (Year: 2002)*
WO_2019028484_A1_I_translate (Year: 2018)*

*Primary Examiner* — Megan Anderson
(74) *Attorney, Agent, or Firm* — Lee & Hayes P.C.

(57) ABSTRACT

This application describes a mobile cycling apparatus which may be easily installed in transportation terminals (and/or other locations) to provide people with an opportunity to exercise. The mobile cycling apparatus described herein may mounted proximate existing seating in the transportation terminals. In some examples, the mobile cycling apparatus may be coupled to the seating, such as a beam seating platform, and/or tables proximate a chair. In some examples, the mobile cycling apparatus may be directly coupled to the floor or other substantially horizontal surface. In some examples, the mobile cycling apparatus may be detachably coupled to a surface (e.g., seating, table, floor, etc.). In such examples, the mobile cycling apparatus may be moved between locations in the transportation terminal.

19 Claims, 17 Drawing Sheets

(58) Field of Classification Search
CPC ..... A63B 2220/40; A63B 2024/0096; A63B 21/225; A63B 2071/0081; A63B 2071/0655; A63B 22/0605; A63B 24/0087; A63B 2022/12; A63B 2022/16; A63B 2022/40; A63B 2024/0093; A63B 2071/0665
See application file for complete search history.

(56) References Cited

U.S. PATENT DOCUMENTS 3,880,153 A * 4/1975 Perrine ..... A63B 69/004 601/40
3,966,201 A * 6/1976 Mester ..... A63B 23/0355 482/62
3,968,963 A 7/1976 Sileo
4,262,902 A * 4/1981 Dranselka ..... A63B 22/0605 482/63
4,688,791 A * 8/1987 Long ..... A63B 22/0605 482/112
4,776,583 A * 10/1988 Jennings ..... A63B 22/001 601/24
D305,677 S 1/1990 Beistegui
D308,085 S 5/1990 Alberta
D324,090 S 2/1992 Miller
D340,269 S 10/1993 Stevens
D342,299 S * 12/1993 Birrell ..... D21/666
D362,699 S * 9/1995 Heaton ..... D21/666
5,472,396 A * 12/1995 Brazaitis ..... A63B 22/0605 482/57
5,496,236 A * 3/1996 Buonauito ..... A63B 21/1609 482/110
6,379,285 B1 * 4/2002 Maresh ..... A63B 22/0605 482/57
6,652,425 B1 * 11/2003 Martin ..... A63B 21/154 482/57
6,902,515 B2 * 6/2005 Howell ..... A63B 22/0012 482/57
7,530,932 B2 * 5/2009 Lofgren ..... A63B 22/0002 482/62
8,795,141 B2 8/2014 Huang
8,920,292 B1 * 12/2014 Myers ..... A63B 21/0055 482/904
9,265,988 B2 * 2/2016 van der Merwe . A63B 22/0605
9,278,251 B2 3/2016 Decca
9,592,421 B2 * 3/2017 Eder ..... A63B 23/12
9,889,337 B2 2/2018 Palmer
10,143,875 B2 * 12/2018 Moschel ..... A63B 21/4031
10,282,914 B1 * 5/2019 Tran ..... G06Q 30/0643
10,543,741 B2 * 1/2020 Biderman ..... G08G 1/202
11,069,436 B2 * 7/2021 Mason ..... G16H 15/00
2004/0142797 A1 * 7/2004 Andre ..... A63B 22/0694 482/57
2005/0282687 A1 * 12/2005 Kazemi ..... A63B 22/0694 482/57
2006/0003872 A1 * 1/2006 Chiles ..... A63B 22/0605 482/8
2006/0199700 A1 * 9/2006 LaStayo ..... A63B 22/0007 482/4
2006/0258520 A1 * 11/2006 Bowser ..... A63B 23/03541 482/121
2007/0117680 A1 * 5/2007 Neff ..... A63B 24/0084 482/8
2007/0293376 A1 * 12/2007 Tsai ..... A63B 22/0605 482/121
2008/0119333 A1 * 5/2008 Bowser ..... A63B 21/156 482/62
2008/0221492 A1 * 9/2008 El'Chonen ..... A61H 1/0214 601/36
2008/0246246 A1 * 10/2008 Dix ..... A61G 5/1054 280/233
2009/0088300 A1 * 4/2009 Catanescu ..... A61H 1/0214 482/51
2009/0105046 A1 4/2009 Rudich
2009/0233767 A1 * 9/2009 Huang ..... A63B 22/0605 482/57
2012/0165085 A1 * 6/2012 Holljes ..... A63B 71/0622 463/7
2012/0329611 A1 * 12/2012 Bouchard ..... A61H 1/0214 482/57
2013/0130798 A1 * 5/2013 Nir ..... A63F 13/245 463/36
2013/0252791 A1 * 9/2013 Chang ..... A63B 23/0222 482/132
2013/0260965 A1 * 10/2013 Chia ..... A63B 22/06 482/57
2014/0011645 A1 * 1/2014 Johnson ..... A63B 23/03525 482/121
2014/0274564 A1 * 9/2014 Greenbaum ..... A63B 21/225 482/5
2014/0274565 A1 * 9/2014 Boyette ..... A63B 22/0694 482/6
2014/0364282 A1 * 12/2014 Moschel ..... A63B 21/4047 482/80
2017/0113092 A1 * 4/2017 Johnson ..... A63B 22/0015
2018/0071572 A1 * 3/2018 Gomberg ..... A63B 22/0015
2018/0185727 A1 * 7/2018 Nelson ..... A63B 71/022
2018/0228682 A1 * 8/2018 Bayerlein ..... A63B 21/00181
2018/0361197 A1 * 12/2018 Lagree ..... A63B 21/4035
2019/0168069 A1 * 6/2019 Chizhov ..... A61H 1/0237
2019/0232106 A1 * 8/2019 Dalmia ..... H04M 1/72409
2020/0114753 A1 * 4/2020 Biderman ..... H02P 6/08
2020/0289882 A1 * 9/2020 Pena ..... A63B 21/1609
2020/0289888 A1 * 9/2020 Neuman ..... A63B 22/0056
2020/0289889 A1 * 9/2020 Hacking ..... A63B 21/00181
2021/0113877 A1 * 4/2021 Chin ..... A63B 21/154
2021/0322820 A1 * 10/2021 Burke ..... A63B 71/0622

* cited by examiner

MOBILE CYCLING APPARATUS

PRIORITY

This application is a continuation of and claims priority to U.S. Provisional Patent Application Ser. No. 63/010,483, filed Apr. 15, 2020 and entitled "Mobile Cycling Apparatus," the entire contents of which is incorporated herein by reference.

BACKGROUND

Millions of people travel through transportation terminals, such as airports, train stations, and the like, on a daily basis. Many spend hours in one or more transportation terminals while traveling to a destination. For example, a person using air transportation may have a four-hour layover at an airport while enroute to a destination. Many travelers experience high degrees of stress and anxiety while traveling, which could be mitigated by exercise; however, transportation terminals rarely provide a means by which travelers may exercise.

BRIEF DESCRIPTION OF THE DRAWINGS

The detailed description is described with reference to the accompanying figures. In the figures, the left-most digit(s) of a reference number identifies the figure in which the reference number first appears. The use of the same reference numbers in different figures indicates similar or identical components or features.

FIG. 8A is a side view of the example mobile cycling apparatus. FIG. 8B is a perspective view of the example mobile cycling apparatus. FIG. 8C is a front view of a coupling between the mobile cycling apparatus and the support of the chair. FIG. 8D is a rear view of the coupling between the mobile cycling apparatus and the support of the chair.

DETAILED DESCRIPTION

As discussed above, millions of people travel through transportation terminals, such as airports, train stations, and the like, on a daily basis. A significant number of travelers experience high degrees of stress and anxiety while traveling. Oftentimes, the stress and anxiety could be mitigated by exercise. However, transportation terminals rarely provide a means by which travelers may exercise.

This application describes a mobile cycling apparatus which may be easily installed in transportation terminals to provide travelers with an opportunity to exercise. The mobile cycling apparatus described herein may mounted proximate existing seating in the transportation terminals. In some examples, the mobile cycling apparatus may be coupled to the seating, such as a beam seating platform. In some examples, the mobile cycling apparatus may be detachably coupled to the beam seating platform. In such examples, the mobile cycling apparatus may be moved between locations in the transportation terminal. In some examples, the mobile cycling apparatus may be coupled to a table or other structure separate from a seat or seating platform. In some examples, the mobile cycling apparatus may be configured to be coupled to a ground surface (e.g., carpet, laminate, wood, etc.) proximate a chair, couch, or other seating apparatus. In some examples, the mobile cycling apparatus may be detachably coupled to the ground surface, such that it is configured to be detached from the floor or other surface at a first location, moved to a second location and attached to the floor or other surface at the second location.

Additionally, this application describes user interfaces for managing workouts via the mobile cycling apparatus. In various examples, a user interface may be associated with a computing device of the mobile cycling apparatus. In some examples, a user interface may be associated with a user computing device. In such examples, the user interface may be configured to communicate with the computing device of the mobile cycling apparatus, such as to modify one or more settings associated with the mobile cycling apparatus.

These and other aspects are described further below with reference to the accompanying drawings. The drawings are merely example implementations and should not be construed to limit the scope of the application. For example, while examples are illustrated in the context of a mobile cycling apparatus used in a transportation terminal, the mobile cycling apparatus may be used in many other environments, such as an office setting, a home, a warehouse, a gym, or other location where people may exercise.

Figure 1:
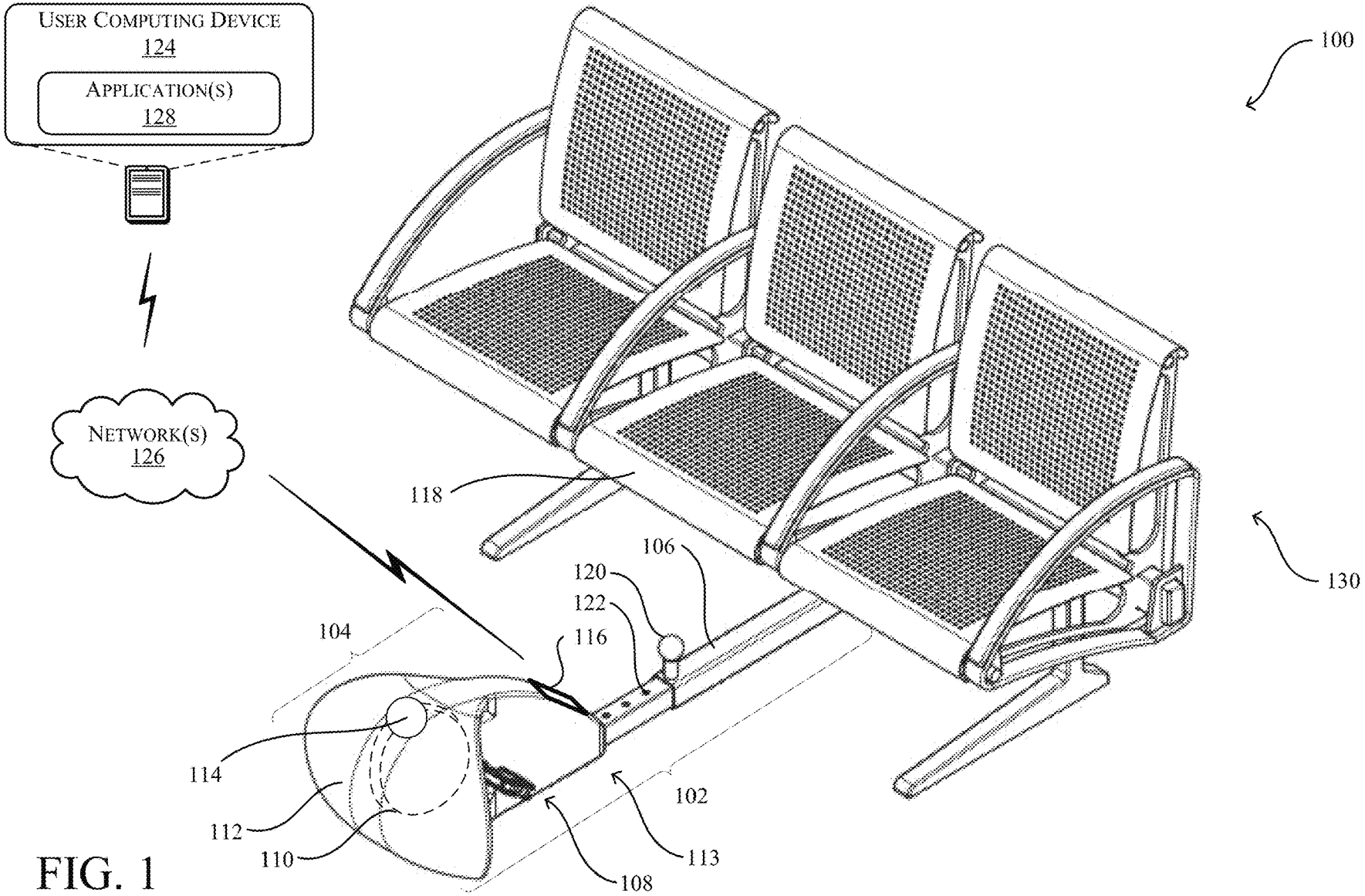
FIG. 1 is a perspective view of an example mobile cycling apparatus, as described herein.

FIG. 1 illustrates an example system 100 associated with a mobile cycling apparatus 102. The mobile cycling apparatus 102 may include a pedal assembly 104 and an extension arm 106. The pedal assembly 104 may include pedals 108 (e.g., two pedals), a flywheel 110, a cover 112 and a base 113. The pedals 108 (single pedal illustrated, but it is understood that a pedal may be located on either side of the pedal assembly 104) may include any material such as metal, plastic, carbon fiber, or a combination of the foregoing. In the illustrative example of FIG. 1, the cover 112 may substantially enclose the pedals 108. In such an example, the cover 112 may include a safety feature to protect objects from getting caught in the pedal assembly 104, such as to protect other people in the terminal proximate the mobile cycling apparatus 102. In various examples, the base 113 may include a bottom side of the mobile cycling apparatus 102. In some examples, the base 113 may include a chassis or other structure to which one or more components of the mobile cycling apparatus 102 couples, such as the flywheel 110, the cover 112, and/or the extension arm 106. In some examples, the base 113 can include an adjustment rail, such as adjustment rail 912 of FIG. 9.

The cover 112 may include a plastic material, a carbon fiber material, a metal material, or a combination of the foregoing. In at least one examples, the cover 112 may include acrylonitrile butadiene styrene (ABS) plastic. In some examples, the cover 112 may include recycled and/or recyclable materials. In some examples, the cover 112 may be opaque. In some examples, at least a portion of the cover 112 may be translucent. In such examples, one or more internal portions of the pedal assembly 104 may be visible to a viewer, such as the flywheel 110. In various examples, the cover 112 may include a fan configured to blow air on a user. In some examples, the fan may be powered, at least in part by the flywheel 110.

In some examples, the cover 112 may have coupled thereto an air purifier, such as that configured to purify air in an area around the mobile cycling apparatus 102. In some examples, the air purifier can be configured to utilize electrostatic purification, such as to introduce negative ions into the air. In such examples, the air purifier can be configured to reduce instances of airborne contaminates in an environment proximate the mobile cycling apparatus 102.

The flywheel 110 may include a magnetic flywheel, a fan-type flywheel, or other type of flywheel. In at least one example, the flywheel 110 may include a steel material (e.g., mild steel, stainless steel, etc.). In various examples the flywheel 110 may be adjustable. In some examples, the flywheel 110 may be adjusted via a mechanical knob 114. In such examples, the mechanical knob 114 may be turned to increase or decrease resistance on the flywheel 110. In some examples, the flywheel 110 may be adjusted via a user interface on a computing device 116. In some examples, a user computing device 124 may be configured to connect to the computing device 116 of the mobile cycling apparatus 102, such as via a network 126, such that the user computing device can control the resistance on the flywheel 110 remotely.

Each of the computing device 116 and the user computing device(s) 124 include one or more processors and memory storing computer executable instructions to implement the functionality discussed herein attributable to the various computing devices. In some examples, the computing devices 116 and the user computing device(s) 124 may include desktop computers, laptop computers, tablet computers, mobile devices (e.g., smart phones or other cellular or mobile phones, mobile gaming devices, portable media devices, etc.), or other suitable computing devices. The computing devices 116 and the user computing device(s) 124 may execute one or more client applications, such as a web browser (e.g., Microsoft Windows Internet Explorer, Mozilla Firefox, Apple Safari, Google Chrome, Opera, etc.) or a native or special-purpose client application (e.g., cycling applications, etc.), to access and view content over the network 126.

The network 126 may include a wired and/or wireless network. In some examples, the network 126 may represent a network or collection of networks (such as the Internet, a corporate intranet, a virtual private network (VPN), a local area network (LAN), a wireless local area network (WLAN), a cellular network, a wide area network (WAN), a metropolitan area network (MAN), or a combination of two or more such networks) over which the computing device 116 and/or one or more user computing devices 124 may communicate. Additionally, the computing device 116 may be configured to communicate with one or more server computing devices, such as to receive updates to an application associated therewith.

In some examples, the application associated with the computing device 116 may include an instance of an application 128 associated with the user computing device 124. In at least one example, the application 128 can include a cycling application configured to receive user input and cause the mobile cycling apparatus to modify at least one setting. For example, the application 128 may be configured to receive credential information from the user via one or more input/output devices of the user computing device 124, and modify settings of the pedal assembly 104, such as resistance, a position on an adjustment rail (e.g., as described with regard to FIG. 9), and the like.

As illustrated in FIG. 1, the extension arm 106 may extend the pedal assembly 104 to a distance from a seat 118 on which a user may sit to ride the mobile cycling apparatus 102 (e.g., pedal the pedal assembly 104). In the illustrative example, the extension arm 106 is extendable. In such an example, the user may release a locking knob 120 and extend or retract the length of the extension arm 106, such as by locking a pin associated with the locking knob 120 in a hole 122. In other examples, the extension arm 106 may be a fixed length. The extension arm 106 and/or the locking knob 120 and/or pin may include a metal material, a carbon fiber material, a plastic material, or a combination of the foregoing.

Figure 9:
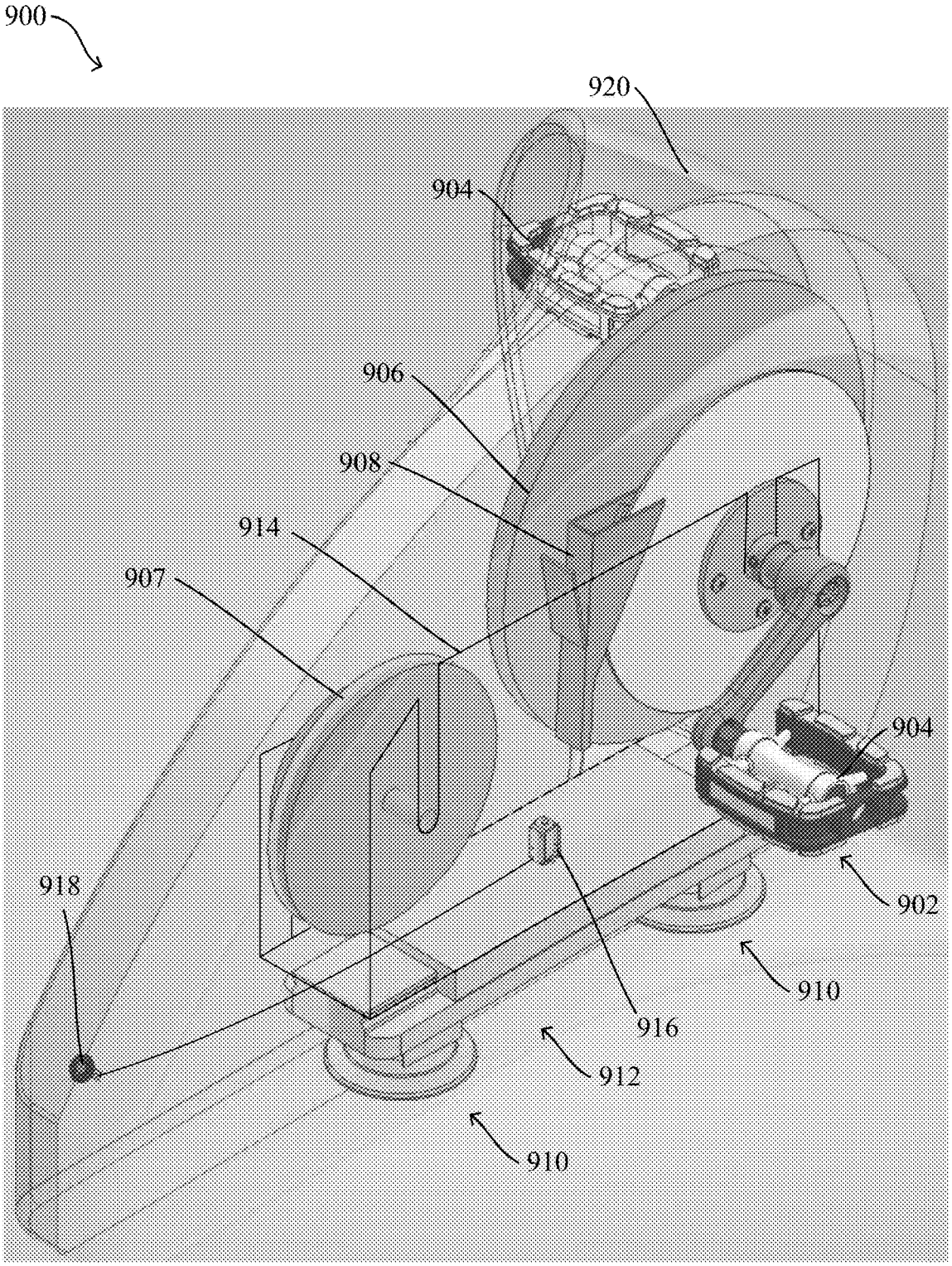
FIG. 9 is a perspective view of an example mobile cycling apparatus configured to be coupled to a substantially horizontal surface, as described herein.

In various examples, the extension arm 106 may be a coupler, such as coupler 910 of FIG. 9, that is configured to securely couple the mobile cycling apparatus 102 to a surface in the environment. In some examples, the extension arm 106 (e.g., coupler) may be configured to limit movement (e.g., lateral, longitudinal, vertical, etc.) of the pedal assembly 104 to less than a threshold amount of movement (e.g., (e.g., threshold lateral, threshold longitudinal, threshold vertical, etc.). In other words, the extension arm may prevent extraneous movement of the pedal assembly and/or the mobile cycling apparatus 102 when an operating user is pedaling the mobile cycling apparatus 102.

In the illustrative example, the seat 118 may include a seat of a beam seating platform 130. In other examples, the seat 118 may include a stand-alone chair, a chair associated with a table, or any other type of seating apparatus. The mobile cycling apparatus 102 may be coupled to the seat 118 (e.g., a leg of the table, etc.), a table or other structure proximate the seat 118, a floor and/or other surface on which the mobile cycling apparatus 102 may rest. In some examples, the mobile cycling apparatus 102 may be coupled to the beam seating platform 130.

In various examples, the mobile cycling apparatus 102 may include a USB charging port. In some examples, the USB charging port may be capable of being powered, at least in part by at least one of the flywheel 110 or the pedals 108. In some examples, the USB charging port may be associated with the computing device 116.

Figure 2:
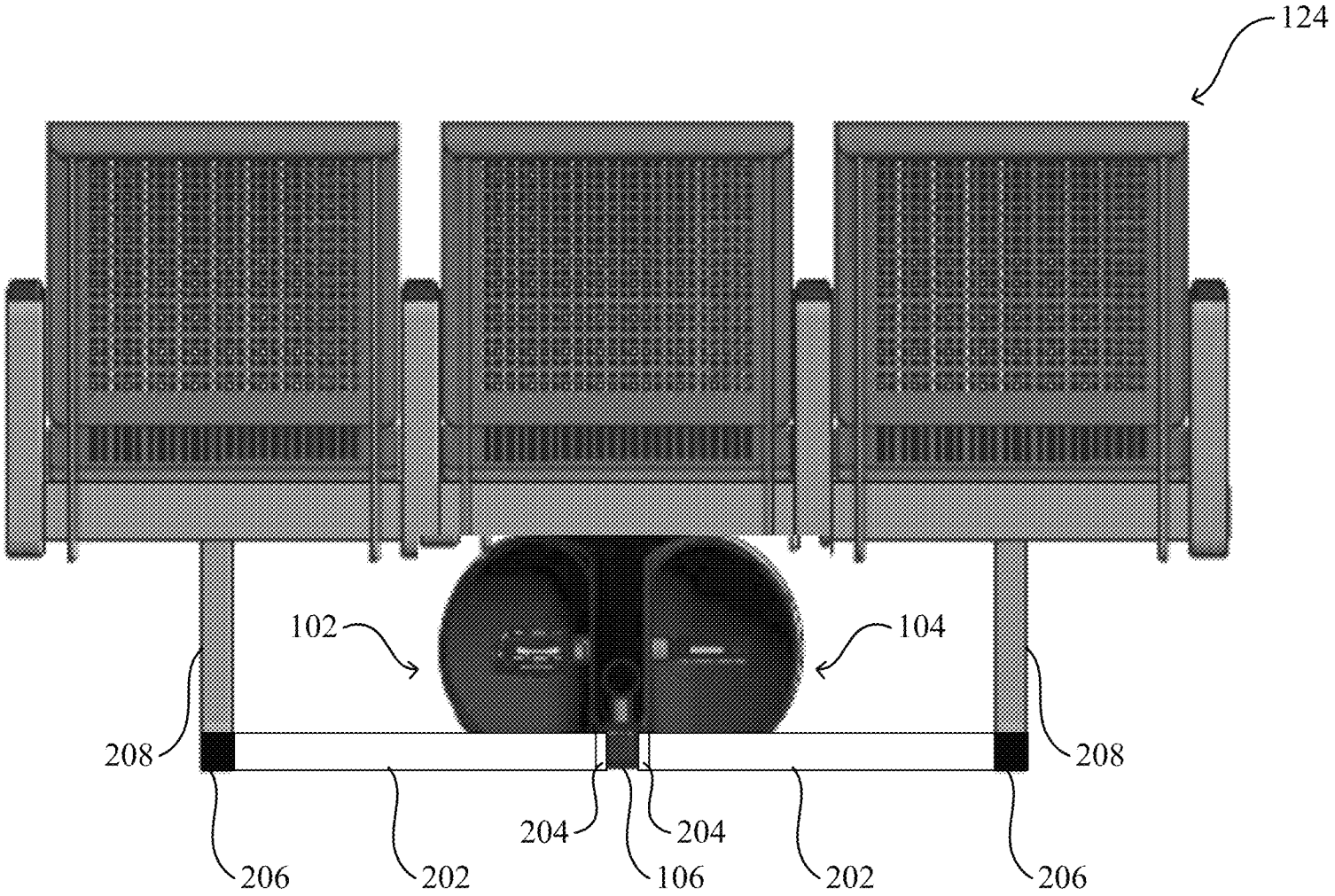
FIG. 2 is a rear view of an example mobile cycling apparatus coupled to a beam seating platform.

FIG. 2 is a rear view of an example mobile cycling apparatus 102 coupled to a beam seating platform 130. In various examples, the mobile cycling apparatus 102 may include one or more coupling arms 202. In some examples, the coupling arm(s) 202 may include a metal material, a plastic material, a carbon fiber material, and/or a combination of the foregoing.

In the illustrative example, the coupling arm(s) 202 may be coupled to an extension arm 106 of the mobile cycling apparatus 102 proximate an opposite end of the mobile cycling apparatus 102 from the pedal assembly 104. In some examples, the coupling arm(s) 202 may be coupled to the extension arm 106 via a first coupling 204. In some examples, the first coupling 204 may include one or more welds, bolts, screws, latched couplings, or the like. In such examples, the coupling arm(s) 202 may rest in a fixed position when coupled to the extension arm 106.

In some examples, the first coupling 204 may include a hinged coupling. In such examples, the coupling arm(s) 202 may retract from the extended position as shown in FIG. 1 (e.g., coupled to the legs of the beam seating platform 130) to a retracted position in which the coupling arm(s) 202 may be substantially parallel to the extension arm 106.

As illustrated in FIG. 2, the coupling arm(s) 202 may include one or more second couplings 206 configured to couple to one or more legs 208 of the beam seating platform 130 and/or one or more legs of a seat, such as seat 118, a table, or any other structure capable of securely coupling to the mobile cycling apparatus 102.

Figure 3:
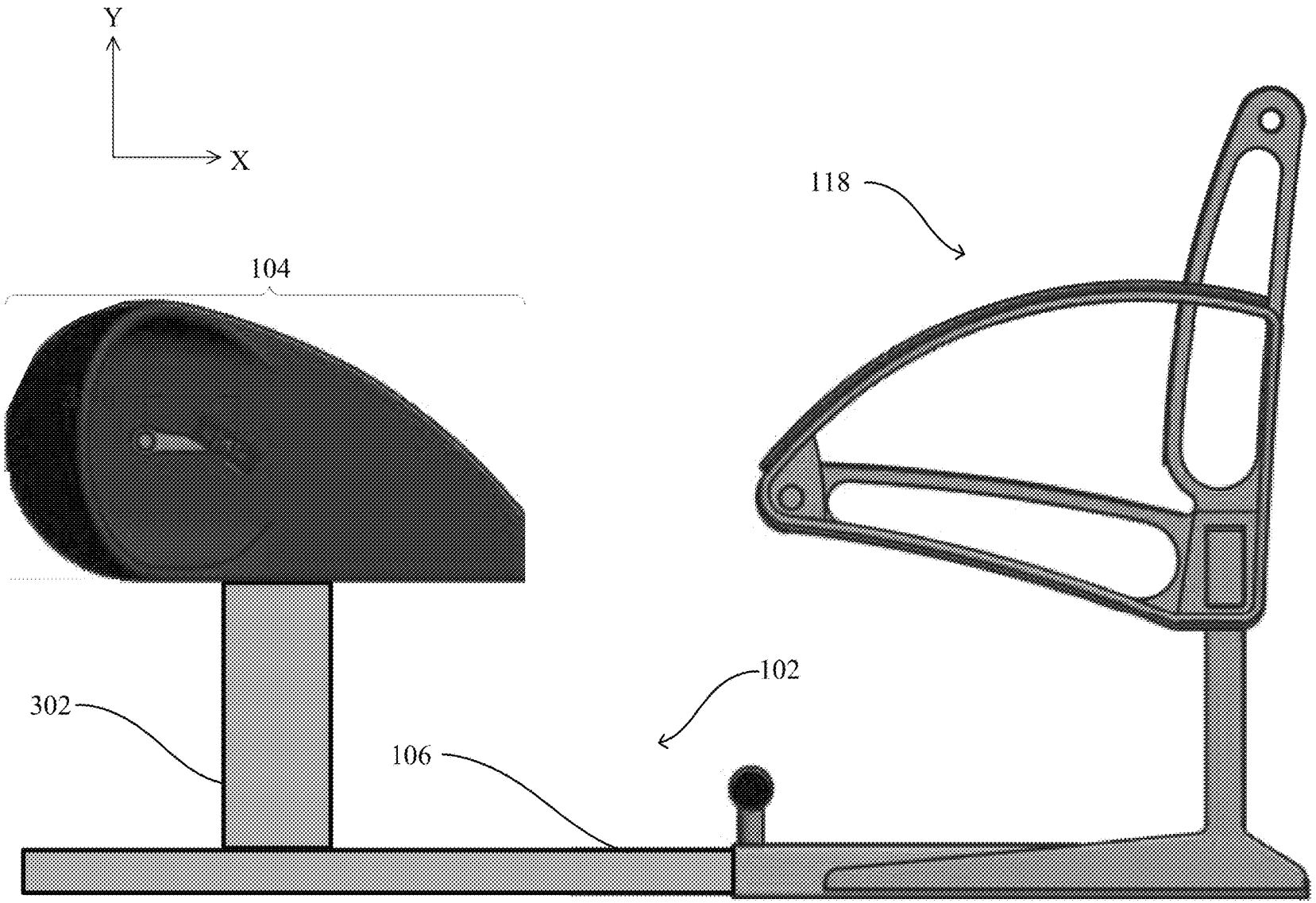
FIG. 3 is a side view of an example mobile cycling apparatus including an adjustable height pedal assembly.

FIG. 3 is a side view of an example mobile cycling apparatus 102 including an adjustable height pedal assembly 104. The mobile cycling apparatus 102 may be coupled to a seat 118, a beam seating platform, such as beam seating platform 130, a table, or other structure, such as via one or more couplings associated with the extension arm 106. As discussed above, the extension arm 106 may be adjustable. In such examples, a pedal assembly 104 may be extended away from the seat 118 and/or moved closer to the seat 118 along the X axis.

In various examples, the pedal assembly 104 may be coupled to a vertical extender 302. In some examples, the vertical extender 302 may be configured to raise the pedal assembly 104 to substantially a height associated with the seat 118. In such examples, a user may pedal the mobile cycling apparatus in a substantially recumbent position. In some examples, the vertical extender may be a fixed height in the Y axis. In various examples, the vertical extender 302 may be adjustable, such as the extension arm 106.

Figure 4:
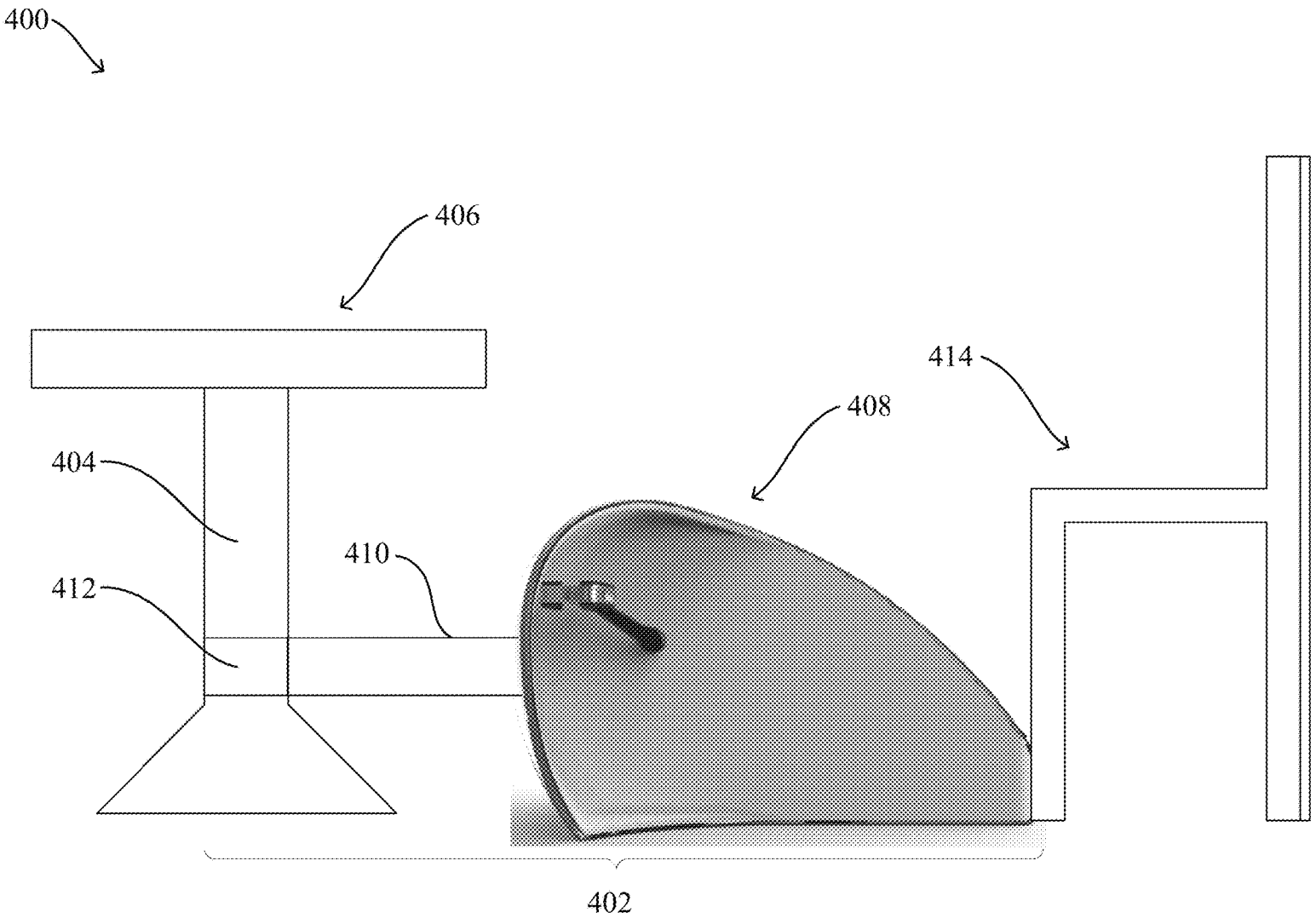
FIG. 4 is a side view of an example mobile cycling apparatus coupled to a table.

FIG. 4 is a side view of an example environment 400 in which a mobile cycling apparatus 402, such as mobile cycling apparatus 102, may be coupled to a leg 404 of a table 406. The mobile cycling apparatus 402 may include a pedal assembly 408, such as pedal assembly 108, and an extension arm 410. As illustrated, the extension arm 410 may extend from a first side of the pedal assembly 408, opposite a second side proximate a chair on which a user may sit to pedal the pedal assembly 408.

In some examples, the extension arm 410 may be a fixed length. In such examples, the pedal assembly 408 may be situated at a fixed distance from the leg 404 of the table 406. In some examples, the extension arm 410 may be adjustable. In such examples, the distance between the pedal assembly 408 and the table 406 and/or the leg 404 the pedal assembly 408 may be adjusted.

In various examples, the extension arm 410 may include a coupling 412 configured to couple to the leg 404 of the table 406. In some examples, the coupling 412 may be configured to couple to a leg of a chair, such as chair 414, a beam seating platform, such as beam seating platform 130, or any other type of stand-alone or clustered chair 414.

The coupling 412 may include a collar coupling, a clamp coupling, a rope coupling, or any other coupling configured to couple the extension arm 410 to the leg 404 of the chair. In some examples, the coupling 412 may include a friction component disposed between the coupling 412 and the leg 404. In such examples, the friction component may prevent movement of the coupling 412 relative to the leg 404. The friction component may include a plastic material, a composite material, a gel material, a foam material, or any other material configured to increase friction between two surfaces.

A user may sit in the chair 414 and pedal the pedal assembly 408.

FIGS. 5A-5D illustrate example interfaces in which a user 502 may initiate and manage a ride on a mobile cycling apparatus, such as mobile cycling apparatus 102 and 402. The example interfaces 500A-500D may be associated with a computing device of the mobile cycling apparatus and/or a user computing device.

Figure 5B:
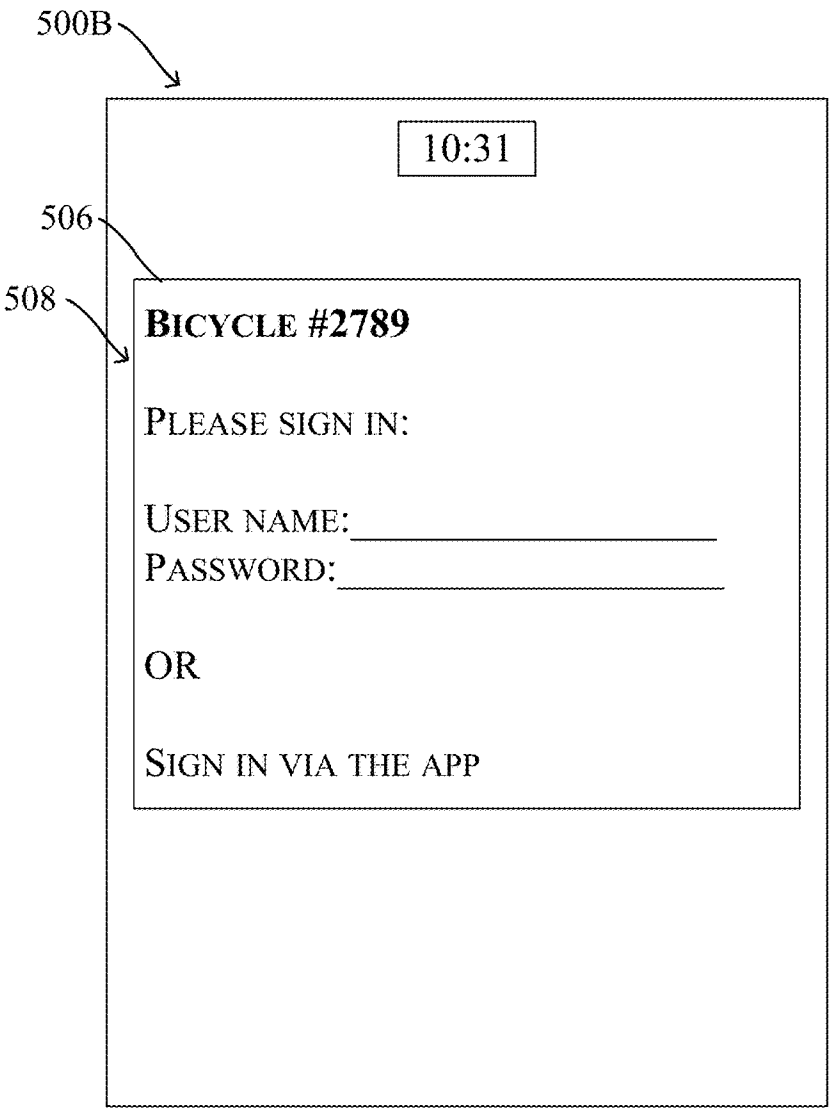
FIGS. 5A-5D illustrate example interfaces in which a user may initiate and manage a ride on a mobile cycling apparatus.
Figure 5A:
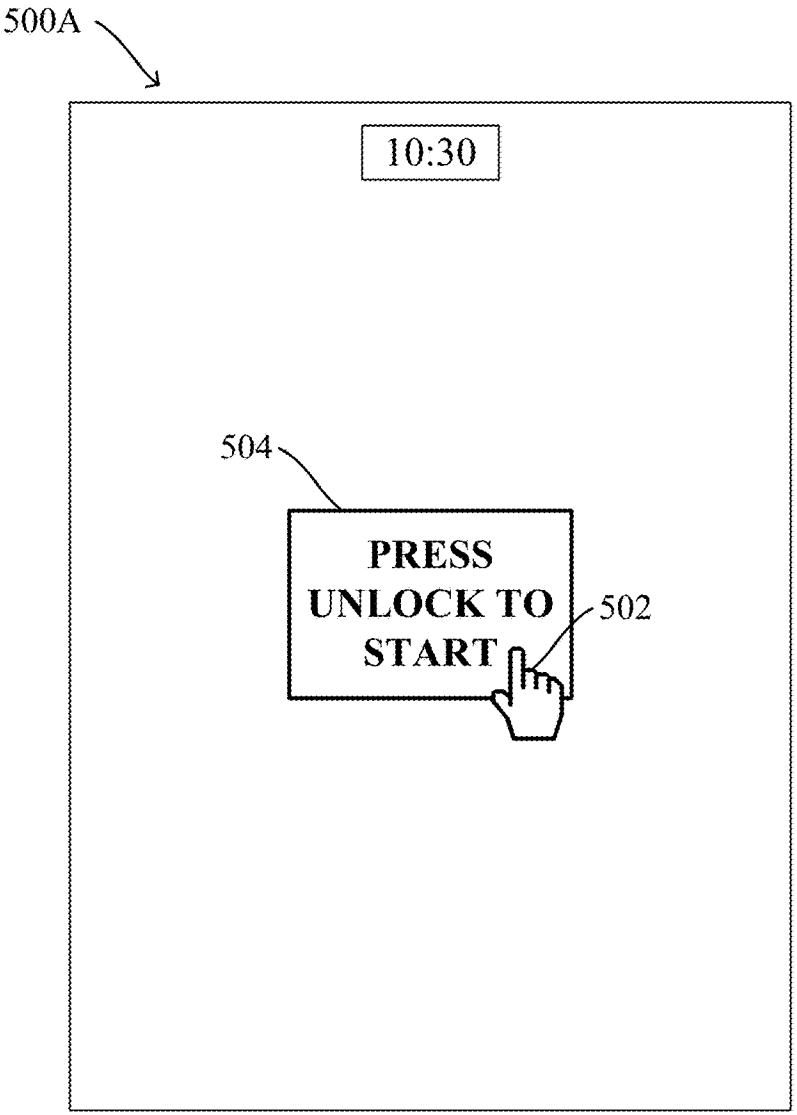

FIG. 5A illustrates a first interface 500A including a locked screen. The locked screen may indicate that a flywheel, such as flywheel 110 of the mobile cycling apparatus is locked, such that the user 502 may be unable to ride it. In the illustrative example, the first interface 500A may include a selectable option 504 to unlock the flywheel 110, such as to start a cycling session.

FIG. 5B illustrates a second interface 500B including a sign in input block 506. In various examples, the second interface 500B may include a waiver of liability for the user 502 to sign prior to unlocking the flywheel. In some examples, the second interface 500B may include an age verification of the user 502 prior to unlocking the flywheel. In such examples, the use of the mobile cycling apparatus may be limited to users 502 of a certain age (e.g., 12 years old, 16 years old, 18 years old, etc.). In various examples, the age verification may ensure safe operation of the mobile cycling apparatus.

The input block 506 enables the user 502 to sign into a program associated with the mobile cycling apparatus. In some examples, the program may provide a means by which the user 502 may track workouts, pay for a ride on the mobile cycling apparatus, or the like. In various examples, the input block 506 may include a bicycle identifier 508. In such examples, the input block 506 may indicate to the user 502 a particular identification of the mobile cycling apparatus.

In various examples, the user 502 may input a username and password to sign into the program associated with the mobile cycling apparatus. In some examples, the user 502 may initiate a sign in by signing in via an application, such as on a user computing device. In some examples, the user 502 may sign in using a credit card. In some examples, the user 502 may sign in by tapping on a user computing device.

Figure 5D:
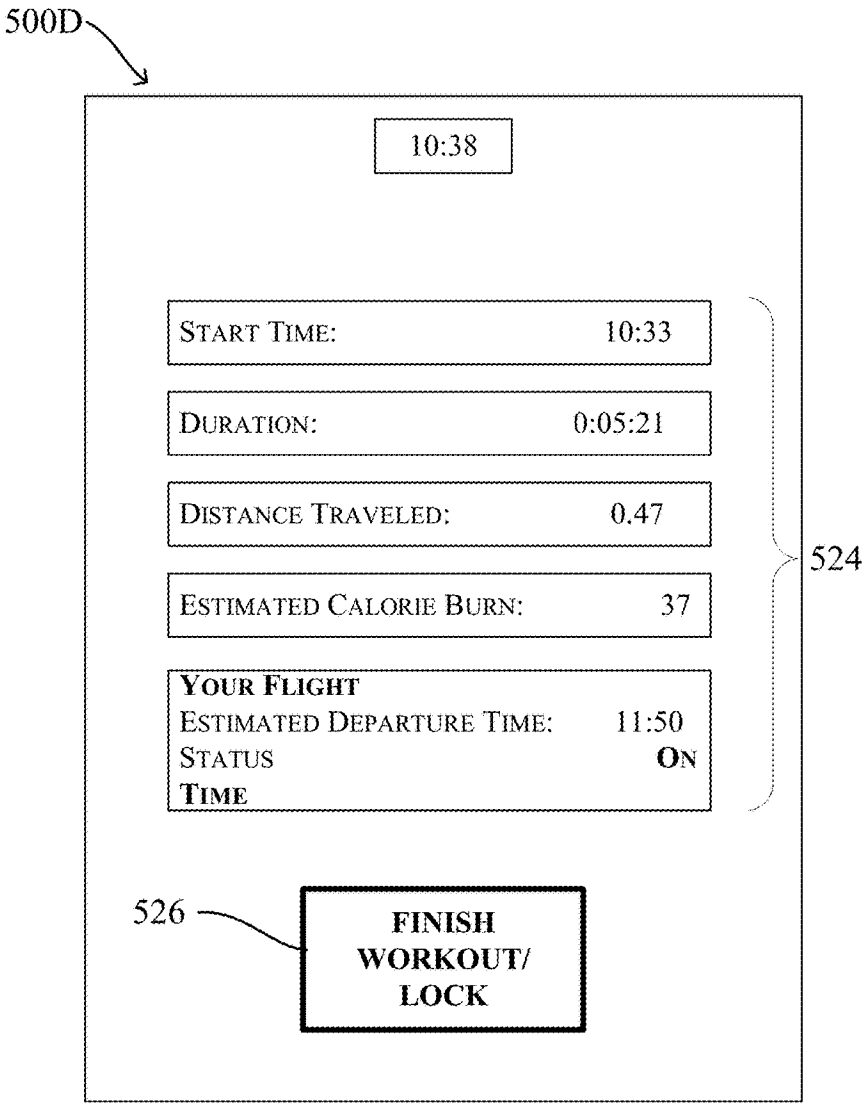
Figure 5C:
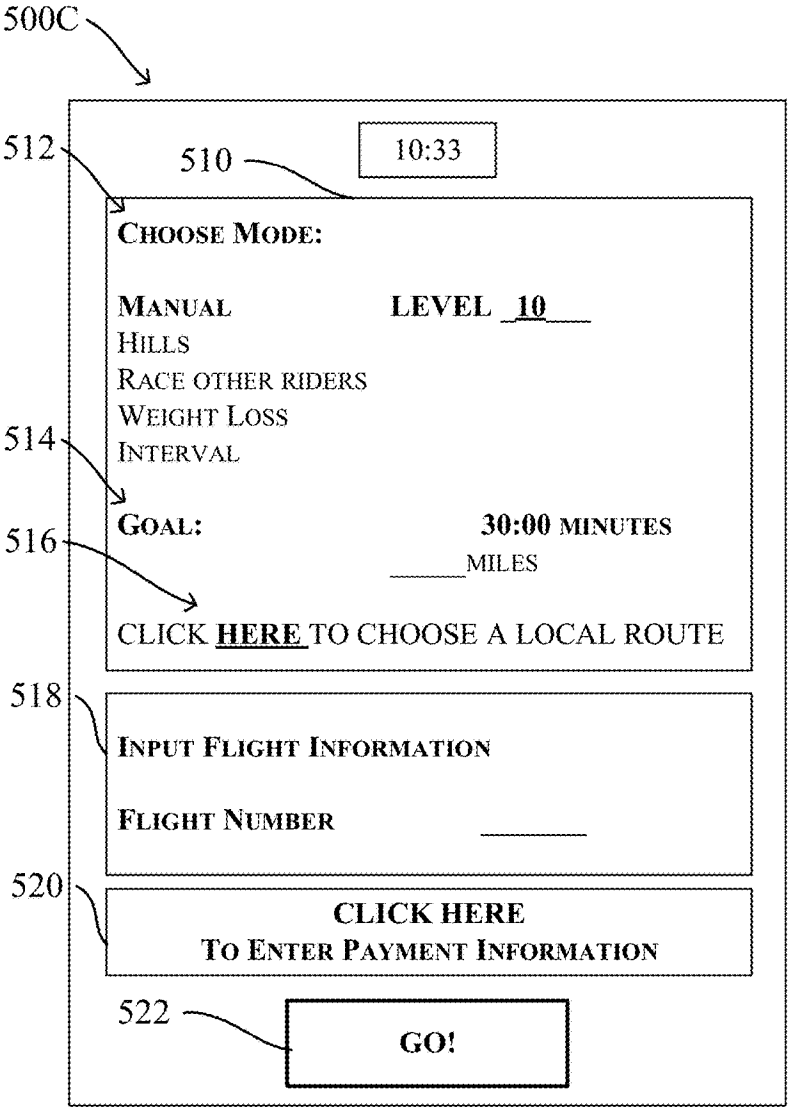

FIG. 5C illustrates a third interface 500C including a set-up input box 510. The set-up input box 510 may include one or more features for setting up the mobile cycling apparatus for a ride. In the illustrative example, the set-up input box 510 includes a mode 512 for a user 502 to choose, a goal 514 to reach, and a route choice 516. In some examples, the route choice 516 may include a themed ride, such as a famous cycling route, a local cycling route associated with a location of the mobile cycling apparatus 102, a local cycling route associated with a destination of the user 502, or the like. In some examples, the set-up input box 510 may include one or more user statistics, such as height, weight, resting heart rate, maximum heart rate, or the like.

In various examples, the third interface 500C may include an information tracking box 518. In the illustrative example, the mobile cycling apparatus may be used in an airport setting (e.g., terminal). As such, the information tracking box 518 may include flight information associated with a flight of the user 502. In other examples, the information tracking box 518 may include train schedule information, bus schedule, social networking inputs, messaging inputs, or any other information. In such examples, the computing device associated with the third interface 500C may be configured to pull or otherwise access information from other computing devices (e.g., server computing devices, user computing devices, etc.). In some examples, the information tracking box 518 may include a means by which the user 502 may input a user name and password associated with the other computing devices and/or information sources.

In some examples, the third interface 500C may include a payment input box 520. The payment input box 520 may include a means by which the user 502 may input a method of payment for use of the mobile cycling apparatus. In various examples, the user 502 may input a coupon code, scan a code (e.g., bar code, QR code, etc.), or otherwise input a code to pay for the ride. In some examples, the coupon code, bar code, or the like may be associated with an airline ticket, an airline, a loyalty program, gym membership or membership in another organization, or the like.

In some examples, the third interface 500C may include an activation button 522. The activation button 522 may enable the use of the mobile cycling apparatus. In some examples, the activation button 522 may unlock the flywheel, set the mode 512, start a timer associated with the ride, initiate payment, or the like.

FIG. 5D illustrates a fourth interface 500D including tracking statistics 524. In the illustrative example, the tracking statistics include start time, duration, distance traveled, estimated calorie burn, and flight information. In other examples, the tracking statistics 524 may include other information, such as goal information, vitals (e.g., heart rate, blood pressure, body temperature, etc.), mode, and/or other information associated with the ride of the user and/or other travel, social networking information, or the like.

In some examples, the fourth interface 500D may include a display of one or more scenic tours. In such examples, the user 502 may view local landscapes associated with a city the mobile cycling apparatus is in and/or in a city associated with a destination of the user 502.

In various examples, the fourth interface 500D may include a means by which the user 502 may post the workout to a social networking site.

In some examples, the fourth interface 500D may include an option to ride for charity. In such examples, the user 502 may be able to select, via a selectable option, to raise money to donate to a charitable cause.

In various examples, the fourth interface 500D may include a selectable input 526 to enable the user to finish the workout and/or lock the flywheel.

Figure 6:
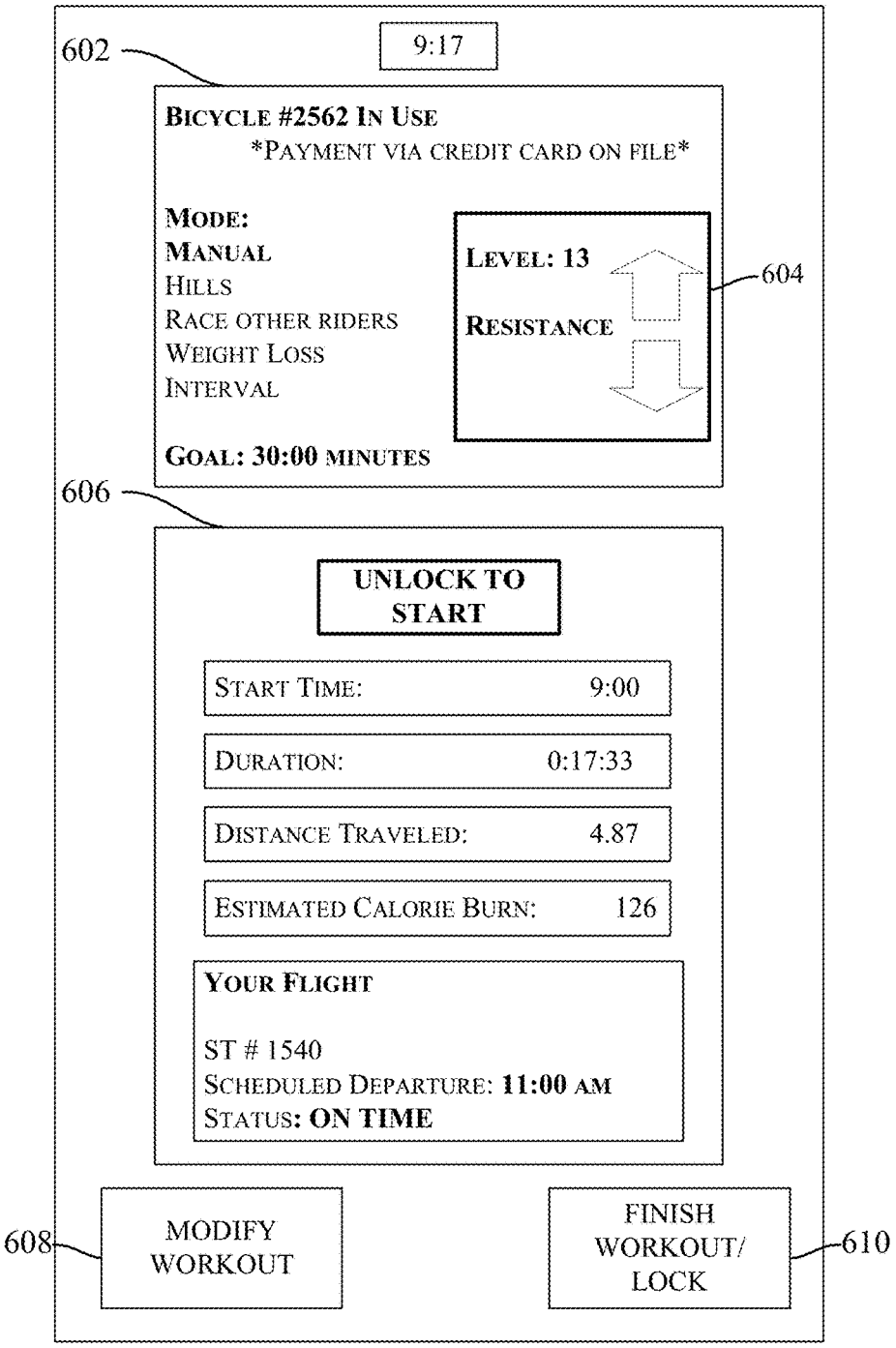
FIG. 6 illustrates an example interface in which a user may initiate and manage a ride on a mobile cycling apparatus.

FIG. 6 illustrates an example interface 600 in which a user may initiate and manage a ride on a mobile cycling apparatus. In various examples, the interface 600 may be associated with a computing device of the mobile cycling apparatus. In at least one example, the interface 600 may be associated with a user computing device. In some examples, the interface 600 may be associated with a cycling application, such as that managed by a server computing device. In some examples, the user may activate the application on the user device, thereby launching the interface 600. In some examples, responsive to launching and/or a search for a mobile cycling apparatus, the interface 600 may surface a map including one or more locations of nearby (e.g., near the associated computing device) mobile cycling apparatuses. In some examples, the user may select a particular mobile cycling apparatus to receive directions thereto and/or reserve for a future period of time.

In the illustrative example, the interface 600 may include a set-up box 602. The set-up box 602 may include one or more features associated with the set-up of the mobile cycling apparatus. In the illustrative example, the set-up box 602 includes a bicycle identifier, payment information, a mode for a user to choose, a goal to reach, and a level to increase or decrease as desired. Additionally, as illustrated, the set-up box 602 includes a resistance adjuster 604. The resistance adjuster 604 may enable the user to increase or decrease resistance on a flywheel of the mobile cycling apparatus, as desired.

In various examples, the interface 600 may include including tracking statistics 606. In the illustrative example, the tracking statistics 606 include start time, duration, distance traveled, estimated calorie burn, and flight information. In other examples, the tracking statistics 606 may include other information, such as goal information, heart rate, mode, and/or other information associated with the ride of the user and/or other travel, social networking information, or the like.

In various examples, the interface 600 may include a first selectable input 608 for modifying a workout. Responsive to selection of the first selectable input 608, the user interface 600 may surface a set-up input box, such as set-up input box 510.

In some examples, the interface 600 may include a selectable input 610 to enable the user to finish the workout and/or lock the flywheel.

Figure 7:
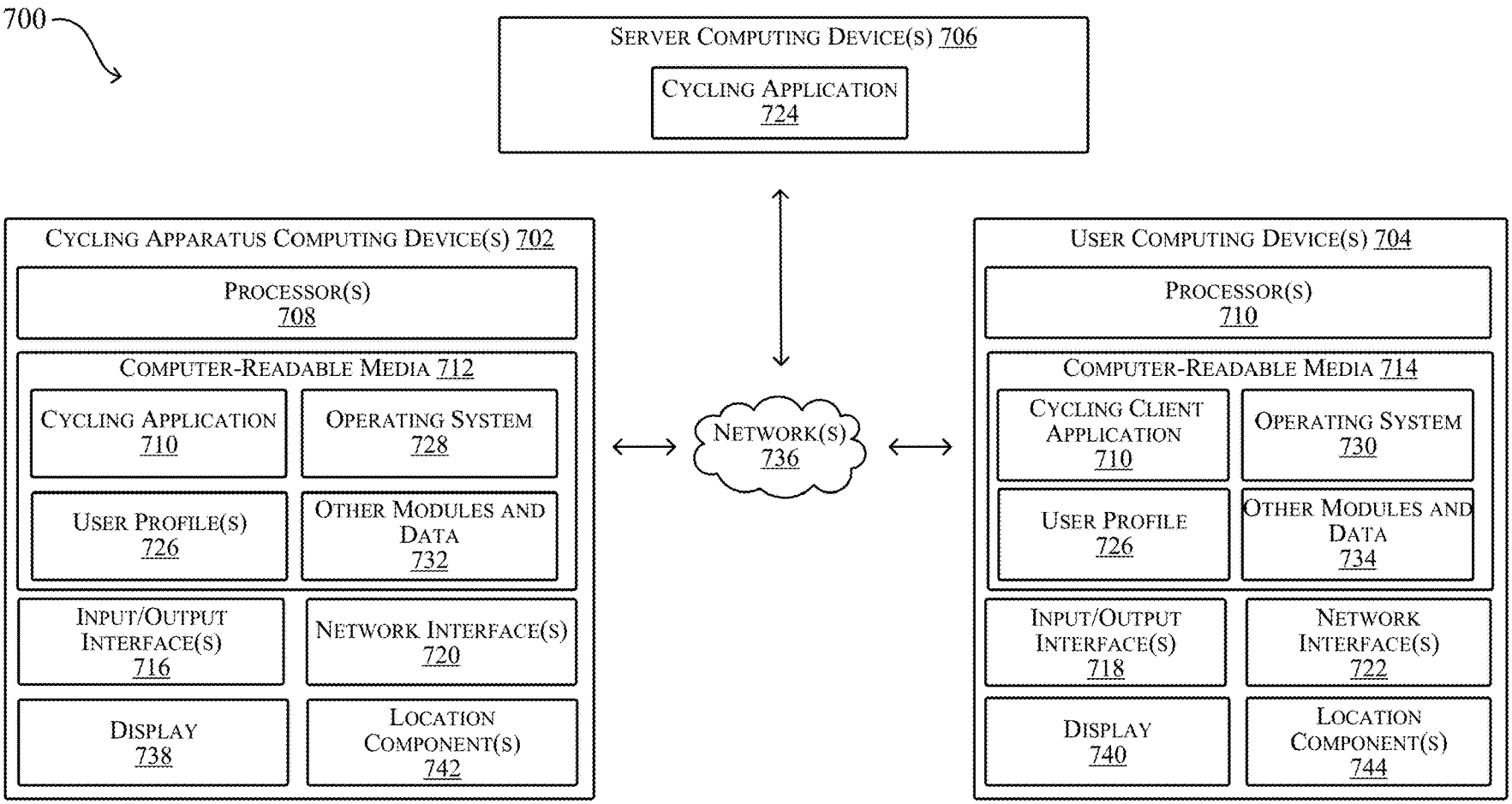
FIG. 7 is a block diagram illustrating an example system of computing devices usable to initiate and manage a ride on a mobile cycling apparatus, as described herein.

FIG. 7 is a block diagram illustrating an example system 700 of computing devices usable to initiate and manage a ride on a mobile cycling apparatus, as described herein. The system 700 may include one or more cycling apparatus computing devices 702, such as computing device 116, one or more user computing devices 704, such as user computing device 124, and/or one or more service computing devices 706.

The cycling apparatus computing device(s) 702, the user computing device(s) 704, and/or the service computing device(s) 706 may be any suitable type of computing device, e.g., mobile, semi-mobile, semi-stationary, or stationary. The cycling apparatus computing device(s) 702, the user computing device(s) 704, and/or the service computing device(s) 706 may belong to a variety of categories or classes of devices such as traditional server-type devices, desktop computer-type devices, mobile devices, special purpose-type devices, embedded-type devices, and/or wearable-type devices. Thus, cycling apparatus computing device(s) 702, the user computing device(s) 704, and/or the service computing device(s) 706 may include a diverse variety of device types and are not limited to a particular type of device. For example, the cycling apparatus computing device(s) 702, the user computing device(s) 704, and/or the service computing device(s) 706 may represent, but is not limited to, desktop computers, server computers or blade servers such as web-servers, map-reduce servers, or other computation engines or network-attached storage units, personal computers, mobile computers, laptop computers, tablet computers, telecommunication devices, network enabled televisions, thin clients, terminals, personal data assistants (PDAs), game consoles, gaming devices, work stations, media players, personal video recorders (PVRs), set-top boxes, cameras, integrated components for inclusion in a computing device, appliances, or any other sort of computing device capable of sending communications and performing the functions according to the techniques described herein.

In the illustrated example, the cycling apparatus computing device(s) 702 and the user computing device(s) 704 include at least one processor 708 and 710, at least one memory 712 and memory 714, one or more input/output (I/O) interfaces 716 and one or more I/O interfaces 718, one or more network interfaces 720 and one or more network interfaces 722. Each processor 708 and 710 may itself comprise one or more processors or processing cores. For example, the processors 708 and/or 710 may be implemented as one or more microprocessors, microcomputers, microcontrollers, digital signal processors, central processing units, state machines, logic circuitries, and/or any devices that manipulate signals based on operational instructions. In some cases, the processors 708 and/or 710 may be one or more hardware processors and/or logic circuits of any suitable type specifically programmed or configured to execute the algorithms and processes described herein. The processors 708 and/or 710 may be configured to fetch and execute computer-readable processor-executable instructions stored in the memory 712 and/or the memory 714.

Depending on the configuration of the cycling apparatus computing device(s) 702 and/or the user computing device(s) 704, the memories 712 and/or 714 may be an example of tangible non-transitory computer storage media and may include volatile and nonvolatile memory and/or removable and non-removable media implemented in any type of technology for storage of information such as computer-readable processor-executable instructions, data structures, program modules or other data. The memories 712 and/or 714 may include, but are not limited to, RAM, ROM, EEPROM, flash memory, solid-state storage, magnetic disk storage, optical storage, and/or other computer-readable media technology. Further, in some cases, the cycling apparatus computing device(s) 702 and/or the user computing device(s) 704 may access external storage, such as RAID storage systems, storage arrays, network attached storage, storage area networks, cloud storage, or any other medium that may be used to store information and that may be accessed by the processor 708 and/or 710 directly or through another computing device or network. Accordingly, the memories 712 and/or 714 may be computer storage media able to store instructions, modules or components that may be executed by the processors 708 and/or 710. Further, when mentioned, non-transitory computer-readable media exclude media such as energy, carrier signals, electromagnetic waves, and signals per se.

Although not illustrated, the server computing device(s) 706 may include one or more processors, such as processors 708 and/or 710, and one or more memories, such as memories 712 and/or 714, as described above. In at least one example, the server computing device 706 may include a cycling application 724. The server computing device 706 may manage the cycling application 724.

The memories 712 and/or 714 may be used to store and maintain any number of functional components that are executable by the processors 708 and/or 710. In some implementations, these functional components comprise instructions or programs that are executable by the processors 708 and/or 710 and that, when executed, implement operational logic for performing the actions and services attributed above to the cycling apparatus computing device(s) 702 and/or the user computing device(s) 704. Functional components of the cycling apparatus computing device(s) 702 and/or the user computing device(s) 704 stored in the memories 712 and/or 714 may include a cycling application 724, one or more user profiles 726.

Additional functional components may include operating system 728 associated with cycling apparatus computing device(s) 702 and operating system 730 associated with user computing device(s) 704 for controlling and managing various functions of the respective devices 702 and 704. The memories 712 and/or 714 may also store other modules and data 732 and/or other modules and data 734, which may include programs, drivers, etc., and the data used or generated by the functional components, to enable efficient and effective food order processing. Further, the cycling apparatus computing device(s) 702 and/or the user computing device(s) 704 may include many other logical, programmatic and physical components, of which those described are merely examples that are related to the discussion herein. In addition, the memories 712 and/or 714 may also store data, data structures and the like, that are used by the functional components.

The I/O interface(s) 716 and I/O interface(s) 718, may include speakers, a microphone, a camera, and various user controls (e.g., buttons, a joystick, a keyboard, a keypad, etc.), a haptic output device, and so forth. The network interface(s) 720 and network interface(s) 722 may include one or more interfaces and hardware components for enabling communication with various other devices over the network 736 or directly. For example, network interface(s) 720 and network interface(s) 722 may enable communication through one or more of the Internet, cable networks, cellular networks, wireless networks (e.g., Wi-Fi) and wired networks, as well as close-range communications such as Bluetooth®, Bluetooth® low energy, and the like, as additionally enumerated elsewhere herein.

FIG. 7 further illustrates that the cycling apparatus computing device(s) 702 and/or the user computing device(s) 704 may also include one or more displays 738 and/or one or more displays 740. Depending on the type of computing device used as the cycling apparatus computing device(s) 702 and/or the user computing device(s) 704, the displays 738 and/or 740 may employ any suitable display technology. For example, the displays 738 and/or 740 may be a liquid crystal display, a plasma display, a light emitting diode display, an OLED (organic light-emitting diode) display, an electronic paper display, or any other suitable type of display able to present digital content thereon. In some examples, the displays 738 and/or 740 may have a touch sensor associated with the displays 738 and/or 740 to provide a touchscreen display configured to receive touch inputs for enabling interaction with a graphical user interface presented on the displays 738 and/or 740. Accordingly, implementations herein are not limited to any particular display technology.

In various examples, the location components 742 and location components 744 may include a GPS subsystem including a device to provide location information. In some examples, the location components 742 and 744 may comprise a non-GPS based location-based sensor. The cycling apparatus computing device(s) 702, the user computing device(s) 704, and/or the server computing device(s) 706 may also include one or more additional sensors, such as an accelerometer, gyroscope, compass, proximity sensor, and the like.

Figure 8A:
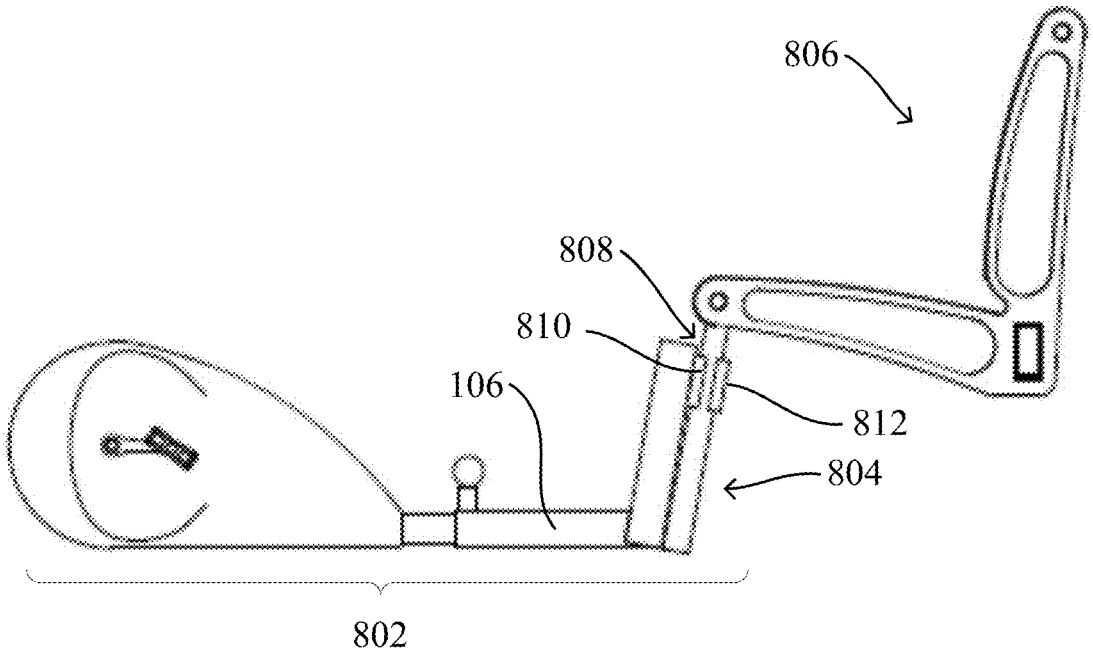
FIGS. 8A-8D illustrate an example mobile cycling apparatus coupled to a support of a chair.

FIGS. 8A-8D illustrate an example mobile cycling apparatus 802 coupled to a support 804 of a chair 806. FIG. 8A is a side view of the mobile cycling apparatus 802. As illustrated in FIG. 8A, an extension arm of the mobile cycling apparatus may include a substantially horizontal portion and a substantially vertical portion. In such examples, the substantially vertical portion may be configured to couple to the support 804 of the chair 806. The support 804 may include a leg of the chair 806 or another supporting element for the chair (e.g., frame for the seat, etc.). The extension arm 106 may couple to the support 804 via a coupling 808. In some examples, such as those illustrated with respect to FIGS. 8C and 8D, the coupling may include a front plate 810 and a rear plate 812. The front plate and the rear plate may be configured to be tightened around the support 804 of the chair, such as via a bolt. In such an example, the mobile cycling apparatus 802 may be detachably coupled to the seat, such that by loosening the coupling, the mobile cycling apparatus 802 may be removed.

Figure 8B:
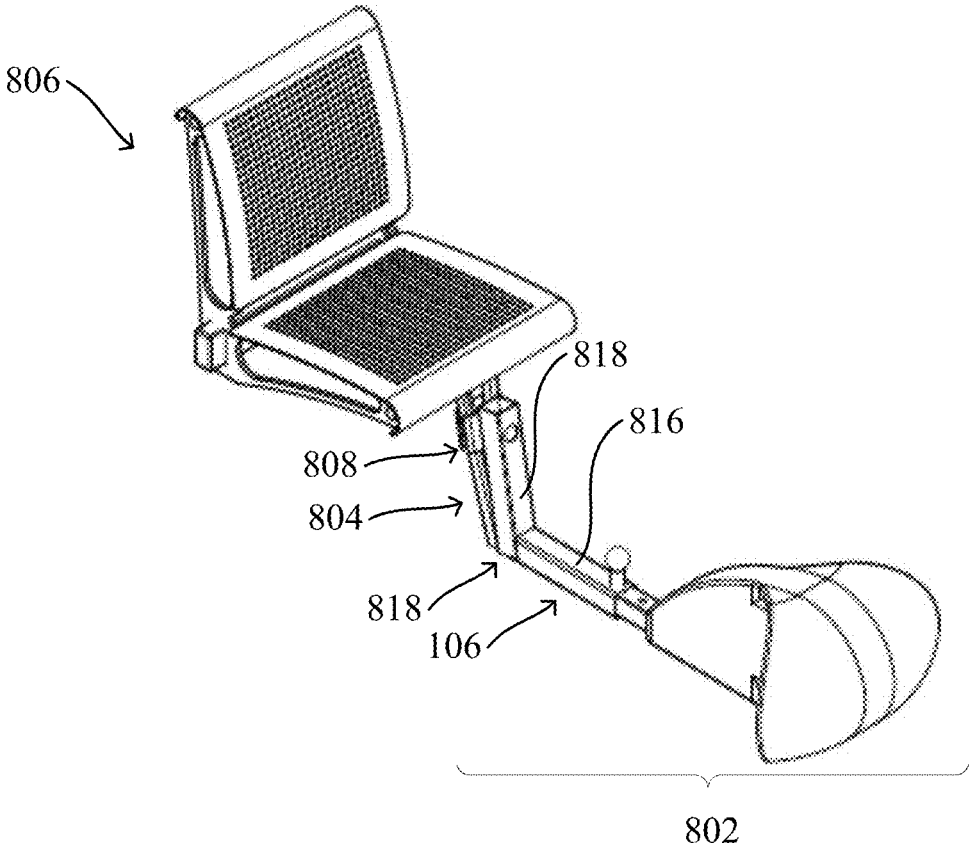

FIG. 8B is a perspective view of the example mobile cycling apparatus. As illustrated in FIG. 8B, the extension arm 106 of the mobile cycling apparatus 802 may include the substantially horizontal portion 816 and the substantially vertical portion 818. The substantially horizontal portion 816 may be configured to rest on a ground surface. The substantially vertical portion 818 may extend at an angle between 30 and 120 degrees from the substantially horizontal portion 816. In some examples, the substantially vertical portion 818 may extend between 70 degrees and 90 degrees from the substantially horizontal portion 816.

In various examples, the substantially horizontal portion 816 and the substantially vertical portion 818 may be coupled to one another at a fixed angle. In such examples, the mobile cycling apparatus 802 may be configured to couple to a support 804 at a fixed angle. In some examples, the substantially vertical portion 818 may be coupled to the substantially horizontal portion 816 via a fixable hinge or other adjustable connection. In such examples, the angle between the substantially horizontal portion 816 and the substantially vertical portion 818 may be modified, such as to enable coupling to various different supports at different angles.

Figure 8C:
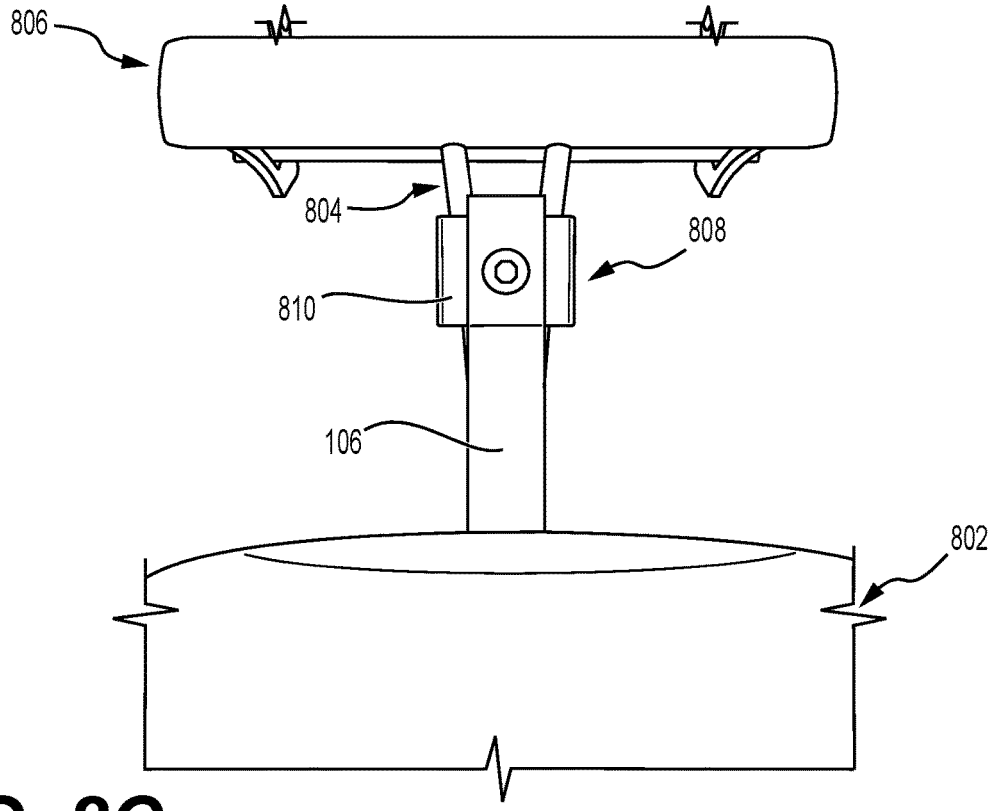

FIG. 8C is a front view of a coupling between the mobile cycling apparatus and the support of the chair. As illustrated in FIG. 8C, the support 804 may include a V-shaped support. In such an example, the coupling 808 may be configured to couple to the V-shape, such as via the front plate 810 and a corresponding rear plate configured to tighten around the support 804. In other examples, the coupling 808 may be configured to couple to other types of supports 804, such as a single leg of the chair 806, two or more legs of the chair 806, a table proximate the chair, or the like.

Figure 8D:
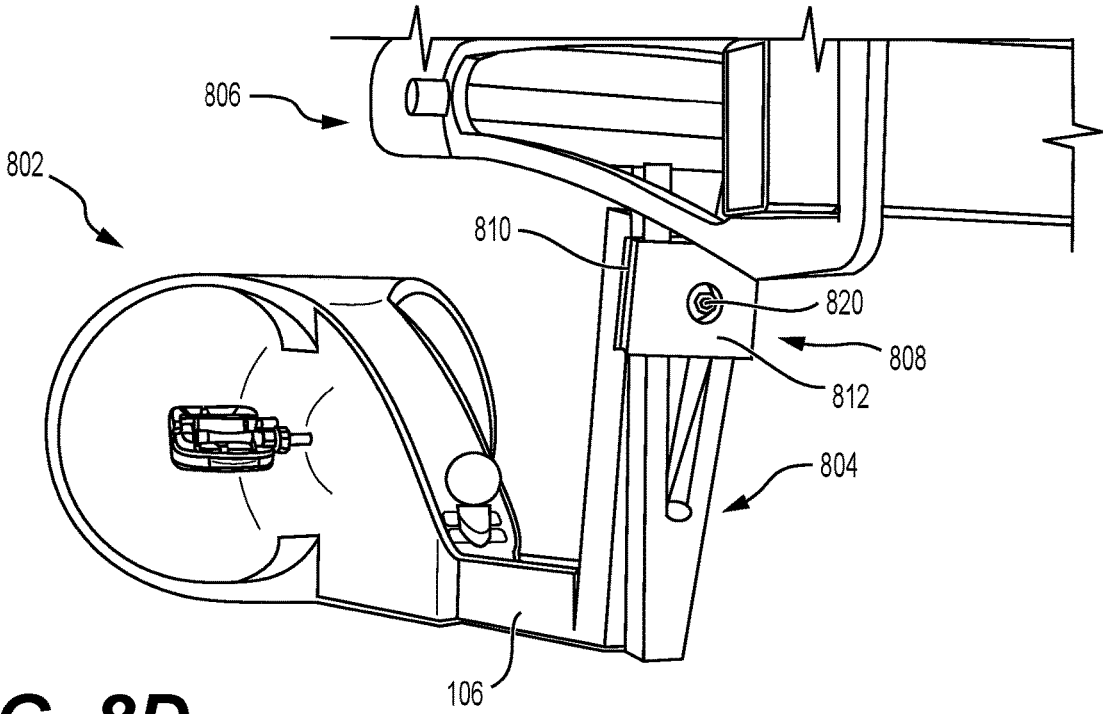

FIG. 8D is a rear view of the coupling between the mobile cycling apparatus 802 and the support of the chair. As illustrated in FIG. 8D, the rear plate 812 may be tightened to the front plate 810, such as via a coupler 820. Though illustrated as a bolt and nut combination, the coupler 820 may include any other type of coupler, such as a screw, clamp, or other type of coupler capable of tightening and securely coupling a portion of an extension arm 106 to a support 804 of a chair 806.

FIG. 9 is a perspective view of an example mobile cycling apparatus 900 configured to be coupled to a substantially horizontal surface. As described above, the mobile cycling apparatus 900 may include a pedal assembly 902, such as pedal assembly 104, the pedal assembly including pedals 904, such as pedals 108. In the illustrative example, the pedals 904 include flat pedals. However this is not intended to be so limiting and the pedals 904 can include pedals with cages, clipless pedals, and the like. In various examples, the pedals 904 can include flat pedals on one side and an attachment for a clipless pedal on an opposing side of the pedal 904. In some examples, the pedals 904 may be detachably coupled to the pedal assembly 902. In such examples, the pedals 904 may be removed and replaced with other pedals 904, such as personal pedals of a user, replacement pedals, or the like.

In various examples, the mobile cycling apparatus 900 may include a flywheel 906, such as flywheel 110. The flywheel may include a magnetic flywheel, a fan-type flywheel, or other type of flywheel. In at least one example, the flywheel 906 may include a steel material (e.g., mild steel, stainless steel, etc.). In various examples the flywheel 906 may be adjustable. In some examples, the flywheel 906 may be adjusted via a mechanical knob. In such examples, the mechanical knob may be turned to increase or decrease resistance on the flywheel 906. In some examples, the flywheel 906 may be adjusted via a user interface on a computing device, such as computing device 116 or a user computing device. In such examples, resistance of the flywheel 906 may be adjustable via a wired or wireless network.

In various examples, the flywheel 906 may be a first flywheel of a flywheel assembly including the first flywheel 906 and a second flywheel 907. In such examples, the first flywheel 906 and the second flywheel 907 may be coupled to each other by a coupling apparatus (not illustrated). The coupling apparatus may include band, a belt, or other coupler that enables rotation of both the first flywheel 906 and the second flywheel 907. In some examples, based on a rotation of the pedals (e.g., based on pressure applied to the pedals and subsequent rotation of the first flywheel 906), the first flywheel 906 may drive a rotation of the second flywheel 907. In various examples, resistance of the flywheel assembly may be generated based on one or more of adjustments to the first flywheel 906 and/or the second flywheel 907, such as based on a movement of a magnet associated therewith, compressing a brake or other resistance generator associated thereto. Such types of resistance generators are known in the art of stationary bicycles and are not described in detail herein.

In various examples, the computing device may be configured to determine data associated with the flywheel 906 and/or the pedal pedals 904 (e.g., data associated with the pedal assembly 902). The data may include resistance associated with the flywheel 906, speed of the pedals 904 (e.g., revolutions per minute), power applied to the pedals 904, and the like. In some examples, the data may additionally include user data associated with a user operating the mobile cycling apparatus 900. The user data may include data associated with the user account (e.g., name, username, age, user preferences, avatar, status (e.g., gold member, platinum member, etc.), user history (e.g., previously recorded rides, recency of rides, longest ride, fastest speed, etc.), and the like. In some examples, the user data may include biometric data. In such examples, the computing device may be communicatively coupled to a remote computing device configured to collect biometric data from the user. As non-limiting examples, the remote computing device can include a heartrate monitor, blood pressure monitor, a watch (e.g., smartwatch, tracker, etc.), and the like. In various examples, the computing device may cause the data to be presented via an associated display. The associated display may include a display of the computing device and/or a display of the remote computing device. For example, the computing device can send the data to the remote computing device with an instruction to present the data via a display. Responsive to receiving the data and the instruction, the remote computing device can present the data via the display.

In various examples, the mobile cycling apparatus may include a locking mechanism 908. In some examples, the locking mechanism 908 may be configured to lock the flywheel 906 and/or the pedals 904 in place, such as to prevent free rotation thereof. In some examples, responsive to receiving a release signal, the locking mechanism 908 may release the flywheel 906 and/or the pedals 904 for movement. In some examples, after release, the mobile cycling apparatus 900 may be used. In coms examples, the locking mechanism 908 may be configured to receive a locking signal, such as from the computing device. In some examples, responsive to receiving the locking signal, the locking mechanism 908 may prevent rotation of the flywheel 906 and/or the pedals 904. In some examples, the locking mechanism 908 may include a safety mechanism. In such examples, the safety mechanism may prevent sudden stopping movements of the flywheel 906 and/or the pedals 904.

In some examples, the locking mechanism 908 may be configured to cause the flywheel 906 and/or pedals 904 to slow at a predetermined rate, such as to prevent injuries. In various examples, the predetermined rate can be determined based on an input received by the computing device. For example, the computing device may receive an input corresponding to an emergency stop and may cause the locking mechanism to slow the flywheel 906 and/or the pedals 904 at an emergency rate. For another example, the computing device may receive an input corresponding to the end of a ride and may cause the locking mechanism 908 to slow the flywheel 906 and/or pedals 904 at a rate corresponding to a normal slowdown. In some examples, the locking mechanism 908 may be configured to cause the flywheel 906 and/or the pedals 904 to slow at a rate that is less than a threshold rate, such as to prevent injuries. In some examples, the locking mechanism 908 may receive a slow or stopping signal from the computing device and may be configured to disengage the flywheel 906 from the pedals 904. In such examples, the locking mechanism 908 may lock the pedals 904, preventing further rotation or operational use, while enabling the flywheel to slow to a stop.

As discussed above, the mobile cycling apparatus 900 may be configured to couple to a chair, table, or other fixture, such as via an extension arm, such as extension arm 106. In the illustrative example of FIG. 9, the mobile cycling apparatus 900 is configured to be detachably coupled to a substantially horizontal surface, such as a floor, a table, or the like, for use. In such examples, the mobile cycling apparatus 900 includes couplers 910 configured to securely couple to the substantially horizontal surface (e.g., a "surface"). Though illustrated as including two couplers 910, this is not intended to be so limiting and a greater or lesser number of couplers 910 are contemplated herein.

In various examples, the couplers 910 may be configured to prevent substantial lateral and/or longitudinal movement of the mobile cycling apparatus 900 with respect to the surface it is coupled to. In some examples, the lateral and/or longitudinal movement may be limited to a threshold amount of lateral and/or longitudinal movement (e.g., 1 centimeter, 0.3 inches, etc.). In other words, the couplers 910 may be configured to securely couple the mobile cycling apparatus 900 to the surface to prevent extraneous movement thereof, when an operating user is pedaling (e.g., causing the pedals to rotate).

In various examples, the couplers 910 can include suction cups configured to couple to a substantially smooth surface, such as a wood, laminate, vinyl, linoleum, tile, or the like. In some examples, the couplers 910 can include a release mechanism that assists in decoupling the couplers 910 from the surface. In such examples, the mobile cycling apparatus 900 may be easily moved from one location to another, by releasing the couplers 910 from a first surface and coupling them to a second surface.

In various examples, the couplers 910 can include hook and loop connectors that are configured to couple to a non-smooth surface. In some examples, the hook and loop connectors can be adhered to a bottom surface of the couplers 910. In some examples, the coupler (and/or a bottom portion thereof) may substantially comprise the hook and loop connectors. In various examples, a type and/or shape of hook and loop connectors may be selected based at least in part on a type of non-smooth surface. For example, a first surface including a short hair carpet may have a corresponding first hook and loop connector (e.g., first type, first shape) and a second surface including a long hair carpet may have a corresponding second hook and loop connector (e.g., second type, second shape).

In various examples, the couplers 910 may be detachably coupled to the mobile cycling apparatus 900. In such examples, the couplers 910 may be removed and replaced with different couplers 910, such as for use on a different surface. For example, a first set of couplers 910 comprising suction cups for a substantially smooth surface may be coupled to the mobile cycling apparatus 900 for use at a first time. The first set of couplers 910 may be released from the substantially smooth surface, such as by engagement of a release mechanism, to move the mobile cycling apparatus to a second location at a second time. The second location may include a carpeted surface (e.g., a second, non-smooth surface). The first set of couplers 910 may be detached from the mobile cycling apparatus 900 and a second set of couplers 910 configured for coupling to the carpeted surface may be attached to the mobile cycling apparatus 900.

In various examples, the mobile cycling apparatus 900 may include an adjustment rail 912, such as to enable a user to adjust a lateral position of the mobile cycling apparatus 900 with respect to the couplers 910. In other words, the adjustment rail 912 may enable the user to modify a location of the pedal assembly 902 with respect to where the user is seated. Though described as manipulating a position of the pedal assembly 902 and consequently the pedals 904, this is not intended to be so limiting as other components of the mobile cycling apparatus 900 also move when adjusted. In various examples, the adjustment rail 912 may include a base of the mobile cycling apparatus 900, such as base 113, to which one or more components are coupled. In the illustrative example, the component(s) are coupled to the adjustment rail 912 via a mounting plate 914. In other examples, the component(s) may be coupled via other couplers, such as one or more beams, and/or other coupling mechanisms known in the art.

In various examples, the pedal assembly 902 including the flywheel 906, the locking mechanism 908, and/or other components of the mobile cycling apparatus 900 may be coupled to the adjustment rail 912, such as via the mounting plate 914. The mounting plate 914 may include a metal material, a plastic material, a composite material, and/or a combination of the foregoing. The mounting plate 914 may be configured to couple one or more the components of the mobile cycling apparatus 900 to the adjustment rail 912, such as to modify a position of the mobile cycling apparatus 900 with respect to the couplers 910 and/or the user. Though illustrated as a substantially U-shaped mount, the mounting plate 914 may include any other shape or configuration to couple components of the mobile cycling apparatus 900 to the adjustment rail 912. For example, the mounting plate 914 may include an L-shaped plate that substantially surrounds interior components of the mobile cycling apparatus 900 (e.g., flywheel, interior components of the pedal assembly 902, etc.).

In various examples, a position of the mounting plate 914 and/or the components of the mobile cycling apparatus 900 may be adjusted along the adjustment rail 912 utilizing a solenoid 916. In various examples, the solenoid 916 may be configured to be manually operated, such as by pressing a release button 918. In some examples, the solenoid 916 may be configured to be remotely operated, such as responsive to receiving a signal from a remote computing device. In some examples, the solenoid 916 may be configured to receive a signal to activate from the remote computing device. Responsive to receiving the signal, the solenoid 916 may release and enable the position of the mobile cycling apparatus 900 to be manipulated.

In some examples, after release of a lock associated with the solenoid 916, the position of the mobile cycling apparatus 900 may be manipulated manually, such as by a user applying pressure on the mobile cycling apparatus 900 to slide along the adjustment rail 912. In such examples, the user may place the mobile cycling apparatus 900 in a desired location and may cause the solenoid 916 to be engaged, locking the mobile cycling apparatus 900 in place with respect to the adjustment rail 912. In various examples, the adjustment rail 912 may include one or more stoppers on opposite ends, to prevent components of the mobile cycling apparatus 900 from departing the adjustment rail 912.

In various examples, the mobile cycling apparatus 900 may include a mechanical adjustment mechanism associated with the solenoid 916. In such examples, the mechanical adjustment mechanism may be configured to move the mobile cycling apparatus 900 along the adjustment rail 912 to a user specified position. In some examples, the solenoid 916 may be configured to be manually operated, such as by a lever, button, or other actuation mechanism. In such examples, an operating user may manually adjust the position of components of the mobile cycling apparatus 900 (e.g., modify a position of the pedal assembly 902 with respect to a position of the operating user). In some examples, the solenoid 916 may be configured to receive a signal from a computing device, such as a computing device of the mobile cycling apparatus 900 or a remote computing device (e.g., user computing device), and may adjust the position of the components of the mobile cycling apparatus 900 based on the signal. For example, the user may input a request to modify the position of the components of the mobile cycling apparatus 900 via a user computing device (e.g., via an application thereon). The user computing device may send a signal to the computing device of the mobile cycling apparatus 900 and/or the solenoid 916, to cause the solenoid 916 to adjust the position of the components based on the request. In such an example, the mobile cycling apparatus 900 may be configurable with little to no "touch points" by a user, such as to prevent the spread of germs.

In some examples, the user specified position may include a position or location of the components of the mobile cycling apparatus that are associated with the user, such as that stored in user data or preferences associated with a user account thereof. In some examples, the computing system may identify the user and/or a user account associated therewith (e.g., based on user sign on, credential data). Based on the user and/or user account identification, the computing device may cause the solenoid to release and the mechanical adjustment mechanism to modify the position and/or location of the mobile cycling apparatus 900 on the adjustment rail 912 based on the user preferences. In other words, the mobile cycling apparatus 900 may be configured to automatically adjust a position based on an identification of an operating user and/or a user preference associated therewith.

As discussed above, the mobile cycling apparatus 900 may include a cover 920, such as cover 112. In various examples, the cover 920 may include a plastic material, a carbon fiber material, a metal material, or a combination of the foregoing. In at least one examples, the cover 920 may include acrylonitrile butadiene styrene (ABS) plastic. In some examples, the cover 920 may be opaque. In some examples, at least a portion of the cover 920 may be translucent. In such examples, one or more components of the mobile cycling apparatus 900 may be visible to a viewer, such as the flywheel 906. In various examples, the cover 920 may include a fan configured to blow air on a user. In some examples, the fan may be powered, at least in part by the flywheel 906 and/or the pedals 904.

Figure 10:
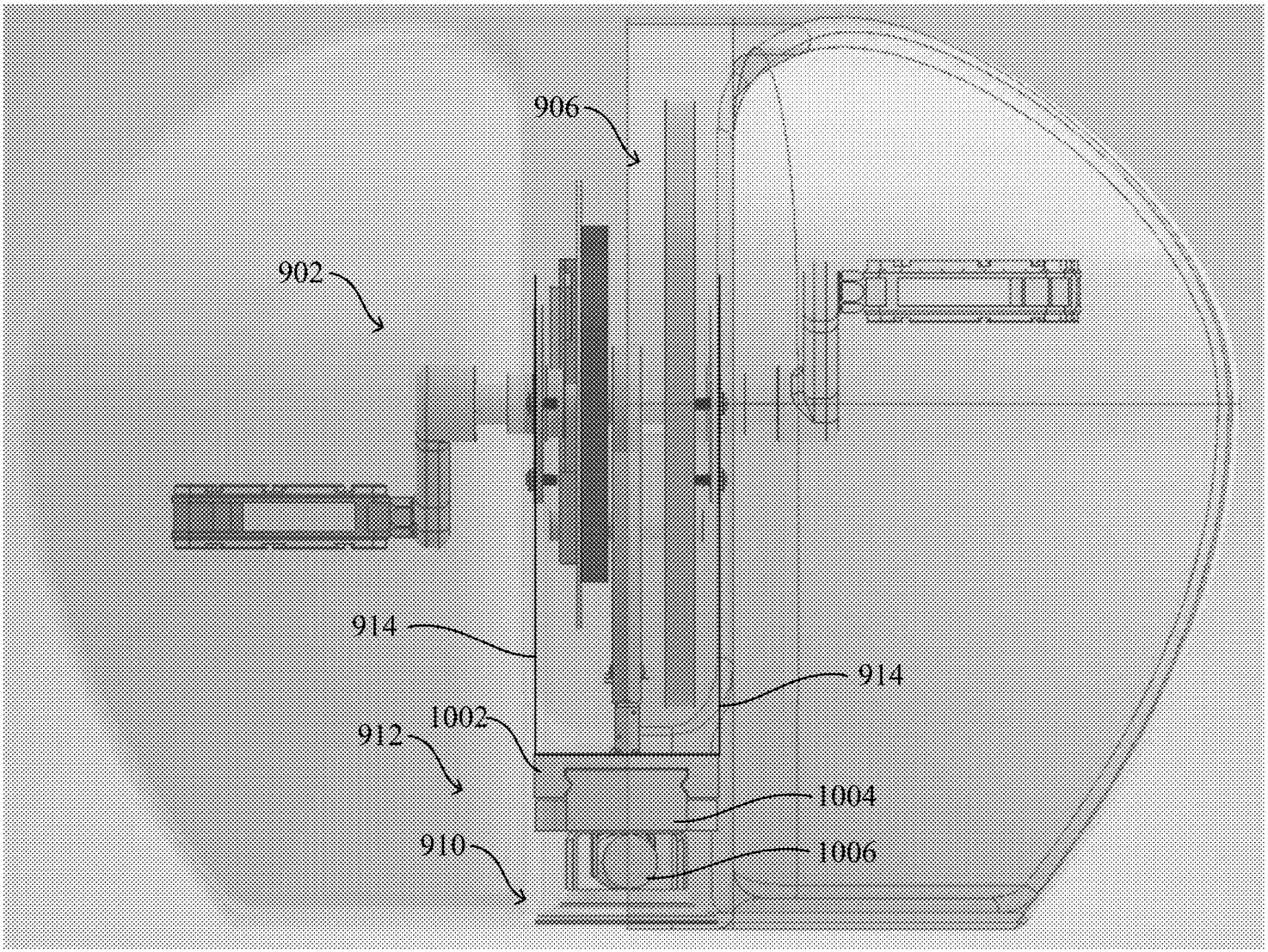
FIG. 10 is a front view of the mobile cycling apparatus of FIG. 9.

FIG. 10 is a front view of the mobile cycling apparatus 900 of FIG. 9. As discussed above, select components of the mobile cycling apparatus 900 may be adjustable along an adjustment rail 912. As illustrated the adjustment rail 912 may include an outer rail 1002 and an inner rail 1004. The select components of the mobile cycling apparatus 900, such as the pedals 904, the flywheel 906, the cover 920, and the like may be coupled to the outer rail 1002, such as via the mounting plate 914.

In various examples, the outer rail 1002 may be configured to couple to and slide along the inner rail 1004. As discussed above, at least one of the inner rail 1004 and/or the outer rail 1002 of the adjustment rail 912 may include one or more stoppers, such as to prevent the outer rail 1002 separating from the inner rail 1004 (e.g., prevent components of the mobile cycling apparatus 900 from departing the adjustment rail 912).

In various examples, the mobile cycling apparatus 900 may be configured to couple to a surface proximate the mobile cycling apparatus 900. In some examples, the surface can include one or more stabilizing surfaces (e.g., leg, etc.) of a chair, a table, a desk, or the like. In some examples, the surface can include a substantially horizontal surface, such as a floor, tabletop, or the like. In such examples, the mobile cycling apparatus 900 may include one or more couplers 910 that are configured to couple the mobile cycling apparatus 900 to the surface. The coupler(s) 910 can include any type of coupler that is configured to prevent substantial movement of the mobile cycling apparatus 900 relative to the surface, such as bolts, screws, suction cups, hook and loop connectors, or the like. In at least one example, the mobile cycling apparatus 900 may be configured to couple to a substantially smooth surface via suction cups. In some examples, the mobile cycling apparatus 900 may be configured to couple to a non-smooth surface, such as carpet, via one or more couplers 910 including hook and loop connectors.

In various examples, the couplers 910 may be configured to detachably release from the surface to which they are coupled. In some examples, the couplers 910 may have associated therewith a release button 1006 that enables the release from the surface. In at least one example in which the couplers 910 include suction cups, the release button 1006 may be configured to introduce air between the coupler(s) 910 and the surface, thereby releasing the coupling.

In various examples, the coupler(s) 910 may be detachably coupled to the mobile cycling apparatus 900. In such examples, the coupler(s) 910 may be removed and replaced with different coupler(s) 910, such as for use on a different surface. For example, a first set of coupler(s) 910 comprising suction cups for a substantially smooth surface may be coupled to the mobile cycling apparatus 900 for use at a first time. The first set of coupler(s) 910 may be released from the substantially smooth surface, such as by engagement of a release mechanism 1006 configured to release one or more of the coupler(s) 910, in order to move the mobile cycling apparatus 900 to a second location. The second location may include a carpeted surface (e.g., a second, non-smooth surface). The first set of coupler(s) 910 may be detached from the mobile cycling apparatus 900 and a second set of coupler(s) 910 that are configured for coupling to the carpeted surface may be attached to the mobile cycling apparatus 900.

Figure 11:
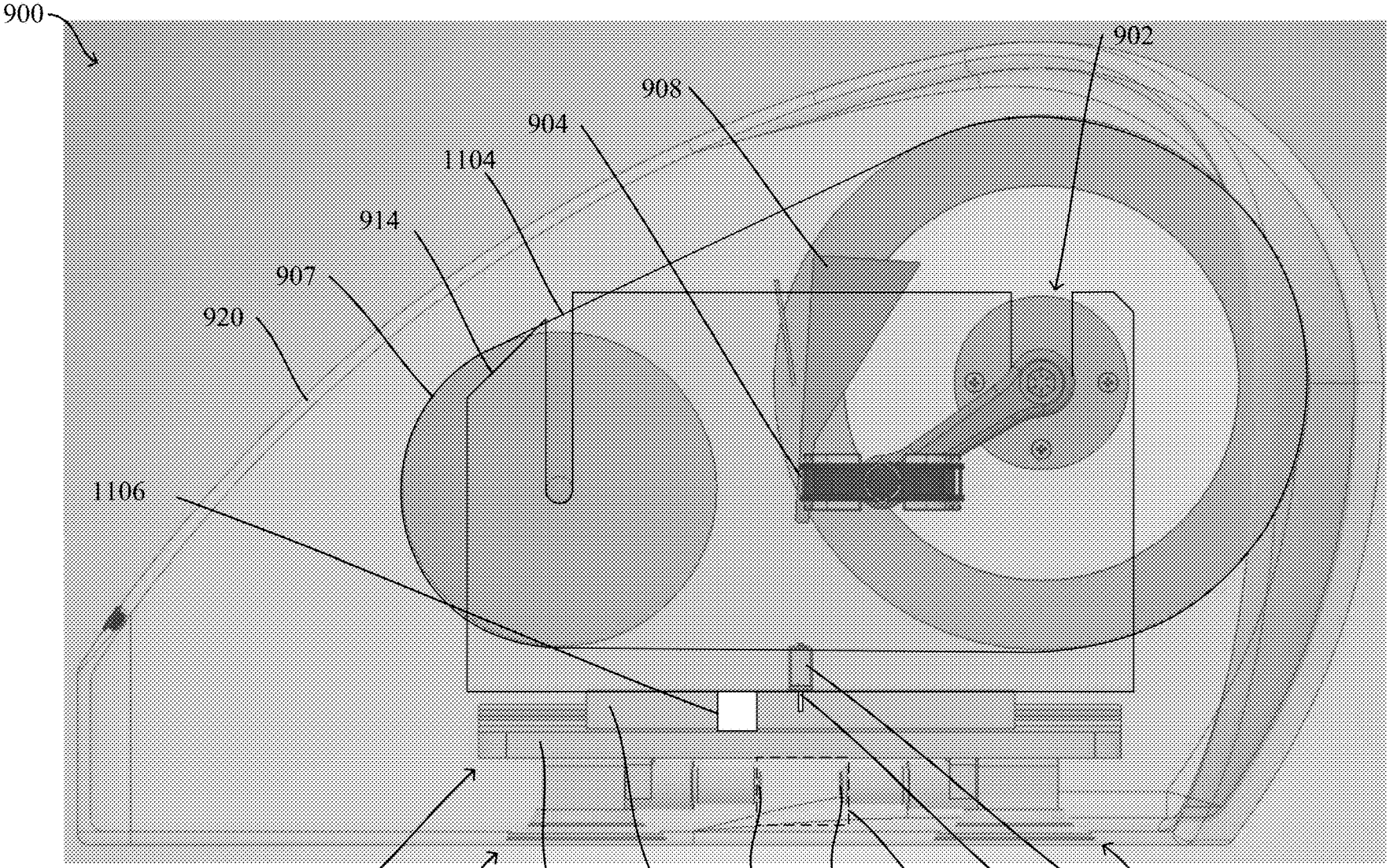
FIG. 11 is a side view of the mobile cycling apparatus of FIG. 9.

FIG. 11 is a side view of the mobile cycling apparatus 900. In various examples, a cover 920 of the mobile cycling apparatus 900 may include one or more access panels 1102. In various examples, the access panel(s) 1102 may include a door, panel, or other piece of material that is configured to be opened and/or removed to provide access to one or more components of the mobile cycling apparatus 900 that are located under the cover 920. In some examples, the cover 920 may be detachably coupled to the mobile cycling apparatus 900, such as to enable a user to remove the cover 920 and access the component(s) located thereunder. In various examples, the cover 920 may include a lock, lever, or other locking mechanism to prevent inadvertent removal of the cover 920 and/or to increase safe operation of the mobile cycling apparatus 900. In the illustrative example, the access panel(s) 1102 may enable access to the release mechanism(s) 1006, such as to release the couplers 910 of the mobile cycling apparatus 900 for movement thereof. In other examples, the access panel(s) 1102 may enable access to additional or alternative components, such as the locking mechanism 908, the solenoid 916, a component of the adjustable rail 912, a covered component of the pedals 904, the flywheel 906, and/or the like.

As illustrated in FIG. 11, the mobile cycling apparatus 900 may include a coupling apparatus 1104 configured to couple the first flywheel 906 and a second flywheel 907 of the mobile cycling apparatus 900. The coupling apparatus 1104 may include band, a belt, or other coupler that enables rotation of both the first flywheel 906 and the second flywheel 907. In some examples, based on a rotation of the pedals (e.g., based on pressure applied to the pedals and subsequent rotation of the first flywheel 906), the first flywheel 906 may drive a rotation of the second flywheel 907.

In various examples, the mobile cycling apparatus 900 may additionally include a motor 1106 configured to cause a movement of one or more components of the mobile cycling apparatus 900 longitudinally along the adjustment rail 912 (e.g., the base of the mobile cycling apparatus 00). In some examples, a computing device of the mobile cycling apparatus 900, communicatively coupled to the solenoid 916 the motor 1106, may send an instruction to the solenoid 916 to disengage a locking pin 1108 associated with the solenoid 916. In some examples, based on a disengagement of the locking pin 1108, the component(s) may be manually moved longitudinally along the adjustment rail 912 from a first position to a second position. In some examples, based on receiving an indication that the component(s) are in the second position (e.g., receive a request to lock, indication of a position set, etc.), the computing device may cause the solenoid to activate and lock the locking pin 1108 into the outer rail 1002.

In various examples, the mobile cycling apparatus 900 may be configured to automatically adjust a position of the component(s) with respect to the adjustment rail 912. In some examples, the automatic adjustment may be based on a setting or user preference with regard to a user account of an operating user. In such examples, the computing device may receive user input (e.g., credentials, identifying information (e.g., name, phone number, etc.) associated with the operating user) associated with a user identity. The computing device may identify the operating user based on the input and may determine an associated user account associated therewith. The computing device may identify the setting and/or user preference based on the user account, such as in user data stored in association with the user account. Based on the setting and/or user preference, the computing device may send a first signal to the solenoid 916 to disengage the locking pin 1108 and a second signal to the motor 1106 to cause the motor 1106 to engage and move a position of the component(s) based on the setting and/or user preference.

Figure 12:
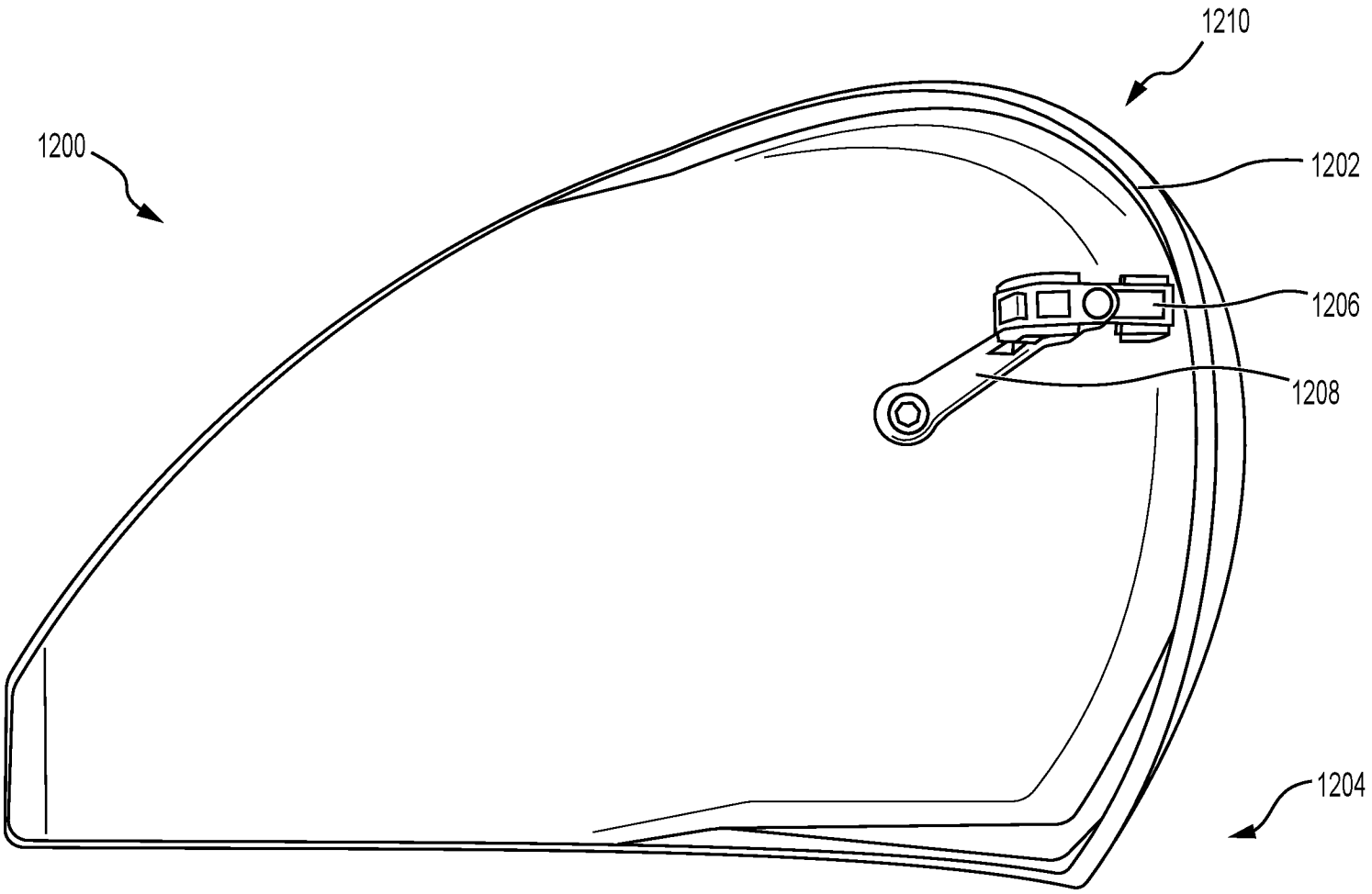
FIG. 12 is a side view of an example mobile cycling apparatus with an opaque casing, as described herein.

FIG. 12 is a side view of an example mobile cycling apparatus 1200, such as mobile cycling apparatus 900 with an opaque cover 1202, such as cover 920, cover 112, etc. The cover 1202 may enclose one or more components of the mobile cycling apparatus. In the illustrative example, the cover 1202 extends to a horizontal surface 1204 on which the mobile cycling apparatus 1200 rests (e.g., surface to which the mobile cycling apparatus 1200 is coupled) In such an example, the cover 1202 encloses the components of the mobile cycling apparatus 1200 with the exception of a pedal 1206, such as pedal 904, and respective pedal arm 1208 of a pedal assembly 1210 (e.g., pedal assembly 104, pedal assembly 902, etc.), on either side of the mobile cycling apparatus 1200. For example, the cover 1202 may enclose a flywheel, a mounting plate, adjustable rail, solenoid, couplers, a portion of an extension arm, such as extension arm 106, and/or other components of the mobile cycling apparatus 1200 as discussed above.

Though illustrated in FIG. 12 as being opaque, this is not intended to be so limiting, and at least a portion of the cover 1202 may be substantially translucent, such as to enable viewing of one or more internal components of the mobile cycling apparatus 1200.

Figure 13:
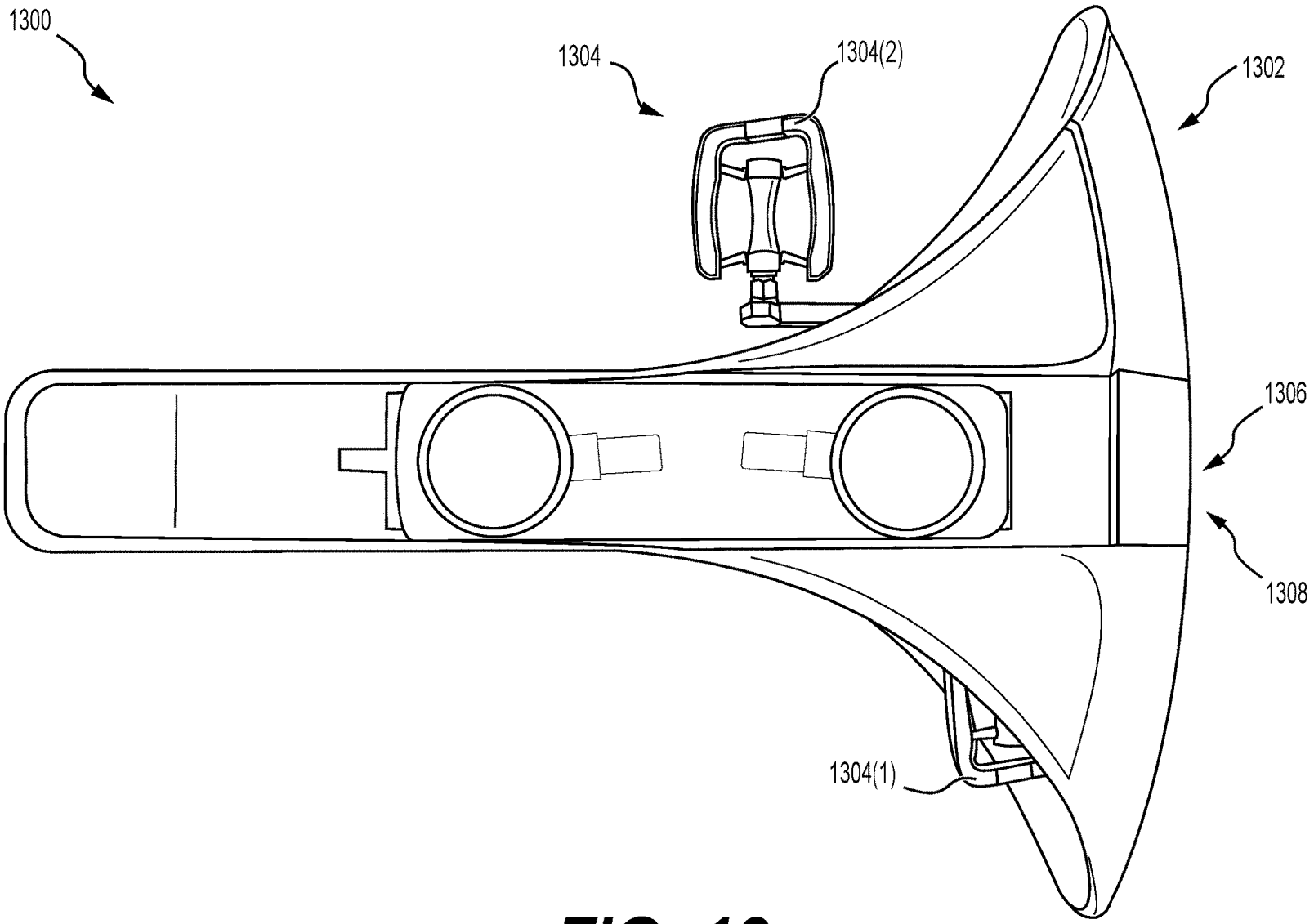
FIG. 13 is a top view of an example mobile cycling apparatus with an opaque casing, as described herein.

FIG. 13 is a top view of an example mobile cycling apparatus 1300, such as mobile cycling apparatus 900 with a cover 1302, such as cover 112, cover 920, cover 1202, and the like. As discussed above, the cover 1202 may be configured to enclose one or more components of the mobile cycling apparatus 1300. As such, the cover 1302 may include a safety feature configured to protect a person proximate the mobile cycling apparatus 1300 from getting injured by one or more moving internal components. Though a portion of the pedals 1304 may be not covered during at least a portion of a rotation (e.g., while an operating user is riding the mobile cycling apparatus 1300), the cover 1302 may be configured to substantially cover the pedals during an opposite portion of the rotation. For example, a first pedal 1304(1) is substantially protected by (e.g., covered by) the cover 1302 while a second pedal 1304(2) at an opposing position is not protected.

As discussed above, the cover 1302 may be opaque. In the illustrative example of FIG. 13, at least a portion of the cover 1302 is substantially translucent, such that one or more internal components of the mobile cycling apparatus 1300 may be visible through the cover 1302. For example, a front center portion 1306 of the cover 1302 may be substantially translucent, enabling a view of a flywheel 1308, such as flywheel 110, flywheel 906, and the like, and/or other components of the mobile cycling apparatus 1300.

Figure 14:
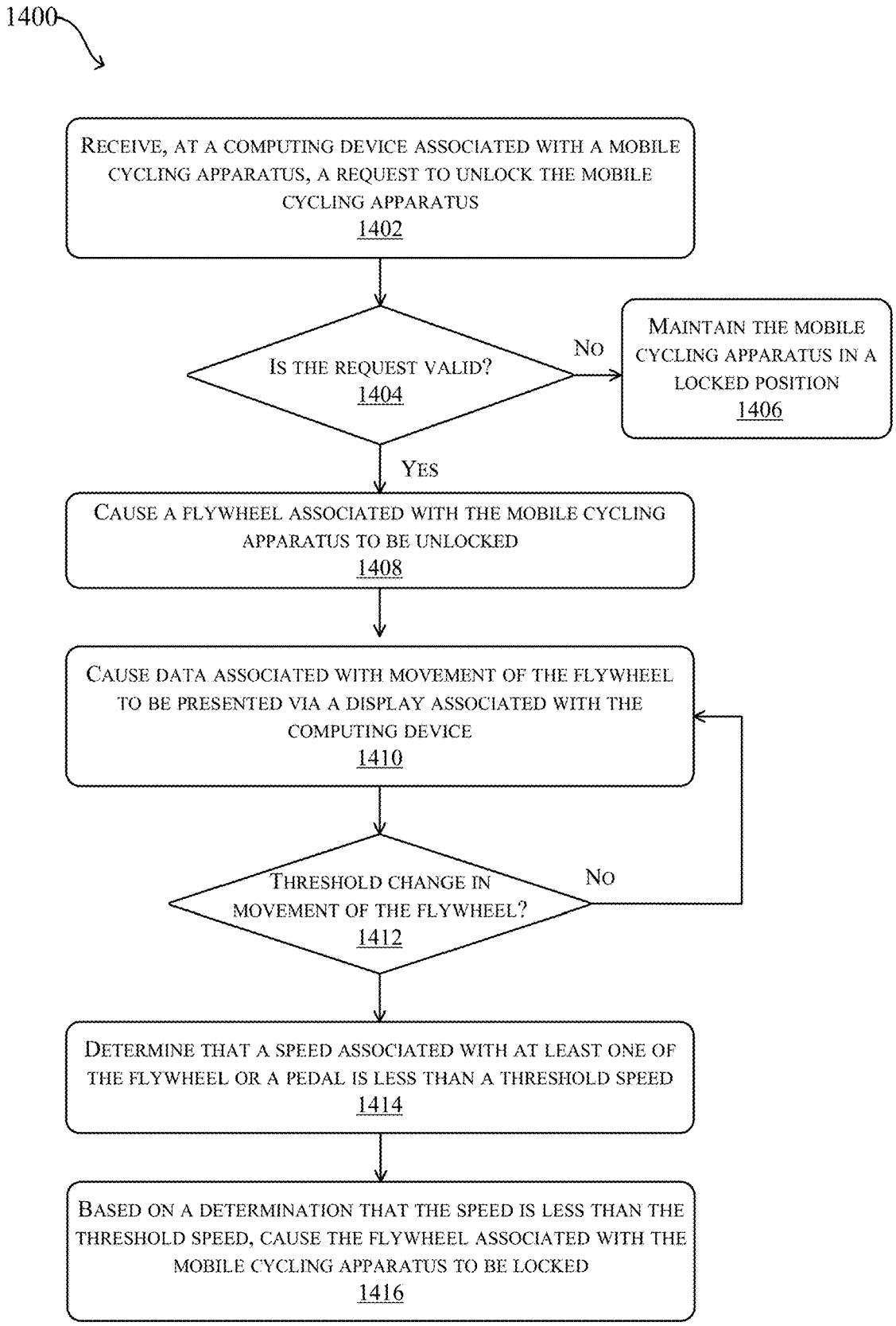
FIG. 14 illustrates an example process for unlocking a mobile cycling apparatus for use, as described herein.
Figure 15:
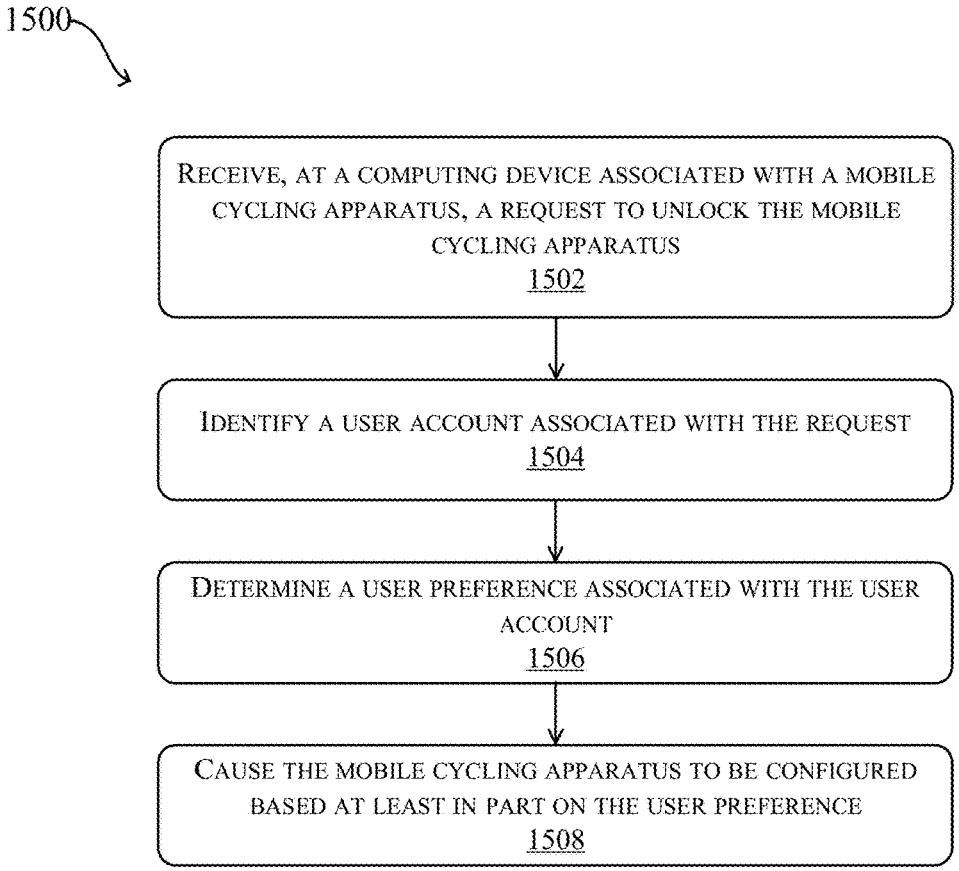
FIG. 15 illustrates an example process for configuring a mobile cycling apparatus based on a user preference, as described herein.

FIGS. 14 and 15 illustrate example processes in accordance with embodiments of the disclosure. These processes are illustrated as logical flow graphs, each operation of which represents a sequence of operations that may be implemented in hardware, software, or a combination thereof. In the context of software, the operations represent computer-executable instructions stored on one or more computer-readable storage media that, when executed by one or more processors, perform the recited operations. Generally, computer-executable instructions include routines, programs, objects, components, data structures, and the like that perform particular functions or implement particular abstract data types. The order in which the operations are described is not intended to be construed as a limitation, and any number of the described operations may be combined in any order and/or in parallel to implement the processes.

FIG. 14 illustrates an example process 1400 for unlocking a mobile cycling apparatus for use. Some or all of the operations of the process 1400 may be performed by a computing device of a mobile cycling apparatus, such as computing device 116 and/or cycling apparatus computing device(s) 702 and/or a user computing device, such as user computing device 124 and/or user computing device 704.

At operation 1402, the process 1400 includes receiving, at a computing device associated with a mobile cycling apparatus, a request to unlock the mobile cycling apparatus. In various examples, the request may be received via an application, such as application 128, cycling application 710, or the like. In some examples, the request may be input via a user computing device and transmitted to a cycling apparatus computing device. In such examples, the system (e.g., system 100, system 700, etc.) may enable a user to engage with a mobile cycling apparatus without physically touching any components thereof, such as to prevent the spread of germs.

In some examples, the request may include credentials associated with a user account of a user. In various examples, the user may sign into the application and submit the request to unlock the mobile cycling apparatus therethrough. In some examples, the user may request to unlock the mobile cycling apparatus by providing particular information via the computing device.

At operation 1404, the process 1400 includes determining whether the request is valid. In some examples, the computing system may determine the validity of the request based on settings associated with the mobile cycling apparatus. For example, a mobile cycling apparatus configured for personal use (e.g., at home, in an office, etc.) may be unlocked responsive to receiving an unlock request via a user interface. For another example, a mobile cycling apparatus configured for public use (e.g., at a gym, a terminal, etc.) may be unlocked responsive to receiving sign in data or additional information in addition to the unlock request input via the user interface.

In some examples, the computing device may determine the request is a valid request based on credentials input via a user interface. In various examples, the computing device may determine that the request is valid based on a determination that the credentials match a user account associated with a user, such as that stored in association with a cycling application. In some examples, the computing device may determine the request is valid based on a determination that the input corresponds to other data stored by or accessible to the computing device, such as travel information (e.g., flight numbers, trip information, etc.). In some examples, the credentials can include a username, password, and the like associated with a user account. In some examples, the credentials can include an email address, phone number, or other contact information associated with the user. In some examples, the credentials may include travel information associated with the user, such as a flight number, bus number, a train number, time associated with take-off, or the like. In such examples, the computing device may be configured to monitor time associated with the ride, such as to ensure the user does not miss a flight, bus, train, etc.

Based on a determination that the credentials are not valid ("No" at operation 1404), the process 1400 at operation 1406, includes maintaining the mobile cycling apparatus in a locked position. In some examples, a locking mechanism associated with the mobile cycling apparatus may remain engaged, locking at least one of the flywheel, the pedals, or another component of the mobile cycling apparatus (e.g., pedal assembly associated therewith).

Based on a determination that the credentials are valid ("Yes" at operation 1404), the process 1400 at operation 1408, includes causing a flywheel associated with the mobile cycling apparatus to be unlocked. In some examples, the flywheel may be unlocked responsive to unlocking one or more pedals of the mobile cycling apparatus, such as to enable the flywheel to spin as the pedals rotate. In various examples, the computing device may send a signal to the locking mechanism to release the lock. In response to receiving the signal, the locking mechanism may unlock the flywheel, configuring the mobile cycling apparatus for use.

At operation 1410, the process 1400 includes causing data associated with movement (e.g., rotation) of the flywheel to be presented via a display associated with the computing device. The data may be presented via a computing device of the mobile cycling apparatus, such as computing device 116 and/or computing device 702 and/or a user computing device such as user computing device 124 and/or user computing device 704, etc., such as via a cycling application.

The data may include resistance associated with the flywheel, speed of the pedals (e.g., revolutions per minute), power applied to the pedals, and the like. In some examples, the data may include biometric data associated with the user. In such examples, the computing device may be communicatively coupled to a remote computing device configured to collect biometric data from the user. As non-limiting examples, the remote computing device can include a heart-rate monitor, blood pressure monitor, a watch (e.g., smartwatch, tracker, etc.), and the like. Additionally, the data may include user data associated with the user operating the mobile cycling apparatus, such as a name, username, age, user preferences, avatar, status (e.g., gold member, platinum member, etc.), user history (e.g., previously recorded rides, recency of rides, longest ride, fastest speed, etc.), and the like.

At operation 1412, the process 1400 includes determining whether a threshold change in the movement of the flywheel is detected. The threshold change may include a change in a speed of the flywheel, a speed of the pedals, or the like. In some examples, the threshold change may include a threshold deceleration of the flywheel, pedals, and the like. In other words, the threshold change may represent an indication that the user is complete with a ride of the mobile cycling apparatus. In various examples, the threshold change in the movement may represent a decrease in a speed of the flywheel and/or a pedal of the pedals to less than a first threshold speed (e.g., 30 revolutions per minute, 20 revolutions per minute, etc.). In some examples, the threshold change in the movement of the flywheel may include the threshold decrease in the speed for a threshold period of time (e.g., 30 seconds, 1 minute, etc.).

Based on a determination that the threshold change in movement is not detected ("No" at operation 1412), the process 1400 includes causing data associated with the movement of the flywheel to be presented via the display, such as that described at operation 1410.

Based on a determination that the threshold change in movement is detected ("Yes" at operation 1412), the process 1400 at operation 1414, includes determining that a speed associated with at least one of the flywheel or a pedal is less than a threshold speed (e.g., less than a second threshold speed). The second threshold speed (e.g., 5 revolutions per minute, 4 revolutions per minute, etc.) may include a speed configured to prevent damage to the mobile cycling apparatus and injury to a user who may still have a foot on a pedal prior to locking the flywheel and/or preventing movement of the flywheel or the pedal.

At operation 1416, the process 1400 includes causing the flywheel associated with the mobile cycling apparatus to be locked based on a determination that the speed is less than the threshold speed. In some examples, the computing device may send a signal to the locking mechanism to lock the flywheel and/or the pedals. Responsive to receiving the signal, the flywheel and/or the pedals may be locked and prevented from rotating. In various examples, locking the flywheel and/or the pedals may increase safety of the mobile cycling apparatus, such as by preventing unauthorized use (e.g., use by small children).

FIG. 15 illustrates an example process 1500 for configuring a mobile cycling apparatus based on a user preference. Some or all of the operations of the process 1500 may be performed by a computing device of a mobile cycling apparatus, such as computing device 116 and/or cycling apparatus computing device(s) 702 and/or a user computing device, such as user computing device 124 and/or user computing device 704.

At operation 1502, the process 1500 includes receiving, at a computing device associated with a mobile cycling apparatus, a request to unlock the mobile cycling apparatus. In various examples, the request may be received via an application, such as application 128, cycling application 710, or the like. In some examples, the request may be input via a user computing device and transmitted to a cycling apparatus computing device. In such examples, the system (e.g., system 100, system 700, etc.) may enable a user to engage with a mobile cycling apparatus without physically touching any components thereof, such as to prevent the spread of germs.

In some examples, the request may include credentials associated with a user account of a user. In various examples, the user may sign into the application and submit the request to unlock the mobile cycling apparatus therethrough. In some examples, the user may request to unlock the mobile cycling apparatus by providing particular information via the computing device.

At operation 1504, the process 1500 includes identifying a user account associated with the request. The computing device may identify the user account based on credentials and/or other user identifying information included in the request (e.g., name, contact information, etc.). In some examples, the user account may be stored in association with the application.

At operation 1506, the process 1500 includes determining a user preference associated with the user account. The user preference may include a setting or other preference of the user. In some examples, the user preference may include an amount and/or type of data to be presented via a display. In some examples, the user preference may include a position of the pedal assembly and/or other components of the mobile cycling apparatus with respect to a base. In such examples, the user preference may indicate the position desired by the user.

At operation 1508, the process 1500 includes causing the mobile cycling apparatus to be configured based at least in part on the user preference. In some examples, the computing device causes a user interface to present data on a display associated with the mobile cycling apparatus based on the user preference. In some examples, the computing device sends a first signal to a solenoid to disengage a locking pin to enable movement of the pedal assembly, pedals, and the like of mobile cycling apparatus, a second signal to a motor to cause the motor to adjust the pedal assembly, pedals, and the like based on the position, and a third signal to the solenoid to engage the locking pin based on the position. In such examples, the mobile cycling apparatus may be automatically set to a desired positional setting based on the user.

EXAMPLE CLAUSES

A: A mobile cycling apparatus comprising: a base; a flywheel coupled to the base; two pedals coupled to the flywheel via respective pedal arms, wherein the flywheel is adjustable and configured to modify a resistance associated with the two pedals; a locking mechanism configured to lock in order to prevent movement of at least one of the flywheel or a pedal of the two pedals and to unlock to enable movement of the at least one of the flywheel or the pedal; a cover configured to enclose the flywheel and at least a portion of a pedal of the two pedals during a pedal rotation; a coupler configured to securely couple the base to a surface in an environment, wherein a coupling between the base and the surface limits lateral movement and longitudinal movement of the mobile cycling apparatus to a threshold amount of lateral movement and longitudinal movement; one or more processors; and one or more non-transitory computer-readable media storing instructions that, when executed by the one or more processors, perform operations comprising: receiving a request to unlock the flywheel; determining that the request is a valid request; and causing the locking mechanism to unlock the at least one of the flywheel or the pedal.

B: The mobile cycling apparatus of paragraph A, wherein the coupler comprises a suction cup configured to couple to a smooth surface.

C: The mobile cycling apparatus of paragraph B, further comprising a release mechanism configured to release the coupler from the surface.

D: The mobile cycling apparatus of any one of paragraphs A-C, wherein the coupler comprises a hook and loop connector configured to couple to a non-smooth surface.

E: The mobile cycling apparatus of any one of paragraphs A-D, wherein the coupler comprises an extension arm configured to couple to at least one of a chair or a table.

F: The mobile cycling apparatus of any one of paragraphs A-E, wherein: the coupler is first coupler that is detachably coupled to the base, the first coupler configured to couple to a first surface; and the base is configured to receive a second coupler that is configured to couple to a second surface.

G: The mobile cycling apparatus of any one of paragraphs A-F, the operations further comprising: causing data associated with the at least one of the flywheel or the pedal to be presented on a display associated with a computing device; determining that a speed associated with the at least one of the flywheel or the pedal is less than a threshold speed for a period of time; and based at least in part on the speed being less than the threshold speed for the period of time, causing the locking mechanism to engage to slow the movement of the at least one of the flywheel or the pedal.

H: The mobile cycling apparatus of paragraph G, the operations further comprising: determining that the speed associated with the at least one of the flywheel or the pedal is less than a second threshold speed; and based at least in part on the speed being less than the second threshold speed, causing the locking mechanism to lock the at least one of the flywheel or the pedal.

I: The mobile cycling apparatus of any one of paragraphs A-I, further comprising a solenoid coupled to the base, the operations further comprising: identifying a user account associated with the request; determining a setting associated with the user account; causing the solenoid to release a locking pin to enable longitudinal movement of at least the two pedals; causing a motor to engage to move the at least the two pedals to a position determined based at least in part on the setting; and causing the solenoid to engage the locking pin based on a determination that the at least the two pedals are at the position.

J: A system comprising: a base; a flywheel coupled to the base; two pedals coupled to the flywheel via respective pedal arms, wherein the flywheel is adjustable and configured to modify a resistance associated with the two pedals; a locking mechanism configured to lock in order to prevent movement of at least one of the flywheel or a pedal of the two pedals and to unlock to enable movement of the at least one of the flywheel or the pedal; a display; one or more processors; and one or more non-transitory computer-readable media storing instructions that, when executed by the one or more processors, perform operations comprising: receiving a request to unlock the flywheel; determining that the request is a valid request; causing the locking mechanism to unlock the at least one of the flywheel or the pedal; causing data associated with the at least one of the flywheel or the pedal to be presented on the display; determining that a speed associated with the at least one of the flywheel or the pedal is less than a threshold speed; and based at least in part on the speed being less than the threshold speed, causing the locking mechanism to lock the at least one of the flywheel or the pedal.

K: The system of paragraph J, further comprising: a coupler configured to securely couple the base to a surface in an environment, wherein a coupling between the base and the surface limits lateral movement and longitudinal movement of the base to a threshold amount of lateral movement and longitudinal movement.

L: The system of paragraph K, wherein the coupler comprises at least one of: a suction cup, a coupler comprising hook and loop connectors; or an extension arm.

M: The system of paragraph K, wherein the coupler is detachably coupled to the base to enable the coupler to be removed and replaced.

N: The system of paragraph K, further comprising a release mechanism configured to decouple the coupler from the surface in the environment.

O: The system of any one of paragraphs J-N, the operations further comprising: determining that a speed associated with the at least one of the flywheel or the pedal is less than a second threshold speed for a period of time; and based at least in part on the speed being less than the second threshold speed for the period of time, causing the locking mechanism to engage to slow the movement of the at least one of the flywheel or the pedal.

P: The system of any one of paragraphs J-O, further comprising a solenoid coupled to the base, the operations further comprising: receiving a second request to adjust a position of the two pedals; causing the solenoid to release a locking pin to enable movement of the two pedals longitudinally with respect to the base; receiving a second indication that the position of the two pedals has been set; and causing the solenoid to engage the locking pin to prevent further movement of the two pedals longitudinally.

Q: A computer-implemented method, implemented by a computing device associated with a mobile cycling apparatus, comprising: receiving, at the computing device associated with a mobile cycling apparatus, a request to unlock the mobile cycling apparatus, wherein the request comprises credentials associated with a user account; based at least in part on validating the credentials, causing a locking mechanism of the mobile cycling apparatus to unlock at least one of a flywheel or a pedal of the mobile cycling apparatus; causing data associated with the at least one of the flywheel or the pedal to be presented on a display associated with the computing device; determining that a speed associated with the at least one of the flywheel or the pedal is less than a threshold speed for a period of time; and based at least in part on the speed being less than the threshold speed for the period of time, causing the at least one of the flywheel or the pedal associated with the mobile cycling apparatus to be locked.

R: The computer-implemented method of paragraph Q, further comprising: determining, based at least in part on the user account, a user preference associated with the data presented on the display, wherein the data presented on the display is based at least in part on the user preference.

S: The computer-implemented method of either paragraph Q or paragraph R, wherein the request is received via: a first user interface associated with the computing device; or a second user interface associated with a user computing device that is communicatively coupled to the computing device.

T: The computer-implemented method of any one of paragraphs Q-S, further comprising: determining, based at least in part on the user account, a user preference associated with a position of a pedal assembly of the mobile cycling apparatus; and causing a solenoid associated with the mobile cycling apparatus to release a locking pin to unlock the mobile cycling apparatus; causing a motor to engage to move the pedal assembly to the position; and causing the solenoid to engage the locking pin based on a determination that the pedal assembly is in the position.

U: A system or device comprising: a processor; and a non-transitory computer-readable medium storing instructions that, when executed, cause a processor to perform a computer-implemented method as any one of paragraphs Q-T describe.

V: A system or device comprising: a means for processing; and a means for storing coupled to the means for processing, the means for storing including instructions to configure one or more devices to perform a computer-implemented method as any one of paragraphs Q-T describe.

While the example clauses described above are described with respect to one particular implementation, it should be understood that, in the context of this document, the content of the example clauses may also be implemented via a method, device, system, a computer-readable medium, and/or another implementation. Additionally, any of examples A-V may be implemented alone or in combination with any other one or more of the examples A-V

CONCLUSION

While one or more examples of the techniques described herein have been described, various alterations, additions, permutations and equivalents thereof are included within the scope of the techniques described herein.

In the description of examples, reference is made to the accompanying drawings that form a part hereof, which show by way of illustration specific examples of the claimed subject matter. It is to be understood that other examples can be used and that changes or alterations, such as structural changes, can be made. Such examples, changes or alterations are not necessarily departures from the scope with respect to the intended claimed subject matter. While the steps herein may be presented in a certain order, in some cases the ordering may be changed so that certain inputs are provided at different times or in a different order without changing the function of the systems and methods described. The disclosed procedures could also be executed in different orders. Additionally, various computations that are herein need not be performed in the order disclosed, and other examples using alternative orderings of the computations could be readily implemented. In addition to being reordered, the computations could also be decomposed into sub-computations with the same results.

What is claimed is:

1. A mobile cycling apparatus comprising:

a base;

a flywheel coupled to the base;

two pedals coupled to the flywheel via respective pedal arms, wherein the flywheel is adjustable and configured to modify a resistance associated with the two pedals;

a locking mechanism configured to lock in order to prevent movement of at least one of the flywheel or at least one of a pedal of the two pedals and to unlock to enable the movement of the at least one of the flywheel or the pedal;

a cover configured to enclose the flywheel and at least a portion of the pedal of the two pedals during a pedal rotation;

a coupler comprising a first element and a second element, wherein the coupler is configured to securely couple the base to a surface in an environment such that the surface in the environment is disposed between the first element and the second element, wherein a coupling between the base and the surface limits lateral movement and longitudinal movement of the mobile cycling apparatus to a threshold amount of the lateral movement and the longitudinal movement;

one or more processors; and one or more non-transitory computer-readable media storing instructions that, when executed by the one or more processors, perform operations comprising:

receiving a request to unlock the flywheel;

determining that the request is a valid request; and causing the locking mechanism to unlock the at least one of the flywheel or the pedal.

2. The mobile cycling apparatus of claim 1, the operations further comprising:

causing data associated with the at least one of the flywheel or the pedal to be presented on a display associated with a computing device;

determining that a speed associated with the at least one of the flywheel or the pedal is less than a threshold speed for a period of time; and based at least in part on the speed being less than the threshold speed for the period of time, causing the locking mechanism to engage to slow the movement of the at least one of the flywheel or the pedal.

3. The mobile cycling apparatus of claim 2, the operations further comprising:

determining that the speed associated with the at least one of the flywheel or the pedal is less than a second threshold speed; and based at least in part on the speed being less than the second threshold speed, causing the locking mechanism to lock the at least one of the flywheel or the pedal.

4. The mobile cycling apparatus of claim 1, wherein the coupler comprises at least one of:

a suction cup configured to couple to a smooth surface;

a hook and loop connector configured to couple to a non-smooth surface; or an extension arm configured to couple to at least one of a chair or a table.

5. The mobile cycling apparatus of claim 1, wherein:

the coupler is first coupler that is detachably coupled to the base, the first coupler configured to couple to a first surface; and the base is configured to receive a second coupler that is configured to couple to a second surface.

6. The mobile cycling apparatus of claim 1, further comprising a solenoid coupled to the base, the operations further comprising:

identifying a user account associated with the request;

determining a setting associated with the user account;

causing the solenoid to release a locking pin to enable longitudinal movement of at least the two pedals;

causing a motor to engage to move the at least the two pedals to a position determined based at least in part on the setting; and causing the solenoid to engage the locking pin based on a determination that the at least the two pedals are at the position.

7. The mobile cycling apparatus of claim 1, wherein the request to unlock the flywheel is received via a user interface of a computing device associated with the mobile cycling apparatus.

8. The mobile cycling apparatus of claim 1, wherein:

the pedal includes a first end;

a second pedal of the two pedals includes a second end; and at least a portion of a perimeter of the cover extends the first end and the second end.

9. A system comprising:

a base;

a flywheel coupled to the base;

two pedals coupled to the flywheel via respective pedal arms, wherein the flywheel is adjustable and configured to modify a resistance associated with the two pedals;

a cover configured to enclose the flywheel and at least a portion of a pedal of the two pedals;

a locking mechanism configured to lock in order to prevent movement of at least one of the flywheel or at least one of the pedal of the two pedals and to unlock to enable the movement of the at least one of the flywheel or the pedal;

a display;

one or more processors; and one or more non-transitory computer-readable media storing instructions that, when executed by the one or more processors, perform operations comprising:

receiving a request to unlock the flywheel;

determining that the request is a valid request;

causing the locking mechanism to unlock the at least one of the flywheel or the pedal;

causing data associated with the at least one of the flywheel or the pedal to be presented on the display;

determining that a speed associated with the at least one of the flywheel or the pedal is less than a threshold speed; and based at least in part on the speed being less than the threshold speed, causing the locking mechanism to lock the at least one of the flywheel or the pedal.

10. The system of claim 9, further comprising:

a coupler configured to securely couple the base to a surface in an environment, wherein a coupling between the base and the surface limits lateral movement and longitudinal movement of the base to a threshold amount of lateral movement and longitudinal movement.

11. The system of claim 10, wherein the coupler comprises at least one of:

a suction cup, a coupler comprising hook and loop connectors; or an extension arm.

12. The system of claim 10, wherein the coupler is detachably coupled to the base to enable the coupler to be removed and replaced.

13. The system of claim 9, the operations further comprising:

determining that a speed associated with the at least one of the flywheel or the pedal is less than a second threshold speed for a period of time; and based at least in part on the speed being less than the second threshold speed for the period of time, causing the locking mechanism to engage to slow the movement of the at least one of the flywheel or the pedal.

14. The system of claim 9, further comprising a solenoid coupled to the base, the operations further comprising:

receiving a second request to adjust a position of the two pedals;

causing the solenoid to release a locking pin to enable the movement of the two pedals longitudinally with respect to the base;

receiving a second indication that the position of the two pedals has been set; and causing the solenoid to engage the locking pin to prevent further movement of the two pedals longitudinally.

15. The system of claim 9, wherein:

the cover includes a first portion and a second portion;

the first portion extends at least partially beyond a first perimeter of the pedal; and the second portion extends at least partially beyond a second perimeter of a second pedal of the two pedals.

16. A method, implemented by a computing device associated with a mobile cycling apparatus, comprising:

receiving, at the computing device associated with the mobile cycling apparatus, a request to unlock the mobile cycling apparatus, wherein the request comprises credentials associated with a user account;

based at least in part on validating the credentials, causing a locking mechanism of the mobile cycling apparatus to unlock at least one of a flywheel or a pedal of the mobile cycling apparatus, wherein the flywheel and at least a portion of the pedal is enclosed by a cover during a rotation of the pedal;

causing data associated with the at least one of the flywheel or the pedal to be presented on a display associated with the computing device;

determining that a speed associated with the at least one of the flywheel or the pedal is less than a threshold speed for a period of time; and based at least in part on the speed being less than the threshold speed for the period of time, causing the at least one of the flywheel or the pedal associated with the mobile cycling apparatus to be locked.

17. The method of claim 16, further comprising:

determining, based at least in part on the user account, a user preference associated with the data presented on the display, wherein the data presented on the display is based at least in part on the user preference.

18. The method of claim 16, wherein the request is received via:

a first user interface associated with the computing device; or a second user interface associated with a user computing device that is communicatively coupled to the computing device.

19. The method of claim 16, further comprising:

determining, based at least in part on the user account, a user preference associated with a position of a pedal assembly of the mobile cycling apparatus; and causing a solenoid associated with the mobile cycling apparatus to release a locking pin to unlock the mobile cycling apparatus;

causing a motor to engage to move the pedal assembly to the position; and causing the solenoid to engage the locking pin based on a determination that the pedal assembly is in the position.

* * * * *